US011592759B2

(12) United States Patent
Yoshida

(10) Patent No.: US 11,592,759 B2
(45) Date of Patent: Feb. 28, 2023

(54) IMAGE FORMING APPARATUS

(71) Applicant: CANON KABUSHIKI KAISHA, Tokyo (JP)

(72) Inventor: Hidefumi Yoshida, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/399,296

(22) Filed: Aug. 11, 2021

(65) Prior Publication Data

US 2022/0066351 A1 Mar. 3, 2022

(30) Foreign Application Priority Data

Aug. 26, 2020 (JP) ..... JP2020-142795

(51) Int. Cl.
*G03G 15/043* (2006.01)

(52) U.S. Cl.
CPC ..... *G03G 15/043* (2013.01)

(58) Field of Classification Search
CPC . G03G 15/04; G03G 15/04072; G03G 15/043
See application file for complete search history.

(56) References Cited

U.S. PATENT DOCUMENTS 9,658,560 B2 5/2017 Yokoi
11,106,153 B2 8/2021 Yoshida
2012/0230713 A1* 9/2012 Sugiyama ..... G03G 15/011 399/51
2013/0235141 A1* 9/2013 Onishi ..... G03G 15/043 347/118
2014/0086611 A1* 3/2014 Nakagawa ..... H02M 3/33507 363/21.02
2015/0362855 A1* 12/2015 Mizuno ..... H01L 51/5012 257/40
2020/0333723 A1* 10/2020 Horiuchi ..... G03G 15/043

FOREIGN PATENT DOCUMENTS

JP 2015-229246 A 12/2015

* cited by examiner

*Primary Examiner* — Carla J Therrien
(74) *Attorney, Agent, or Firm* — Venable LLP

(57) ABSTRACT

An image forming apparatus includes a photosensitive drum which is rotatable; light-emitting portions arranged along a direction of a rotational axis of the photosensitive drum, the light-emitting portions emitting light based on image data in order to expose the photosensitive drum; a reference clock signal generation portion which generates a reference clock signal with a predetermined period; a modulated clock signal generation portion which generates a modulated clock signal with a predetermined modulation period by spreading a spectrum of the reference clock signal and by modulating the predetermined period, wherein the light-emitting portions emit light for a lighting time set based on the modulated clock signal; and a control signal generation portion which generates with a period of n times the predetermined modulation period (n is an integer greater than or equal to 1) a control signal for controlling a timing at which the light-emitting portions emit light.

5 Claims, 28 Drawing Sheets

| PULSE WIDTH TABLE | |
|---|---|
| IMAGE DATA | PULSE WIDTH *b* [CYCLE] |
| 0 | 0 |
| 1 | 10000 |

FIG 22

| PULSE WIDTH TABLE | |
|---|---|
| IMAGE DATA | PULSE WIDTH *b* [CYCLE] |
| 0 | 0(ΔCs × 0) |
| 1 | 4800(ΔCs × 3) |
| 2 | 9600(ΔCs × 6) |
| 3 | 14400(ΔCs × 9) |

IMAGE FORMING APPARATUS

BACKGROUND OF THE INVENTION

Field of the Invention

The present invention relates to an image forming apparatus such as an electrophotographic copying machine and an electrophotographic printer that forms an image on a sheet using the electrophotographic imaging system.

Description of the Related Art

When an image is formed by an electrophotographic image forming apparatus, an electrostatic latent image is first formed on the surface of the photosensitive drum by irradiating the surface of the photosensitive drum with light corresponding to the image data. After that, a toner image is formed by adhering toner to the electrostatic latent image on the surface of the photosensitive drum with the developing device, the toner image is transferred to a sheet, and the toner image transferred to the sheet is fixed on the sheet by heating it with the fixing device.

In addition, the configuration of an image forming apparatus is known in which an exposure head irradiates a photosensitive drum with light to form an electrostatic latent image. The exposure head has a plurality of light-emitting portions arranged in the direction of the rotational axis of the photosensitive drum and a lens that focuses the light emitted from the plurality of light-emitting portions onto the surface of the photosensitive drum. For example, LED and Organic Electro-Luminescence are used for the light-emitting portions. By using such an exposure head, the number of parts can be reduced compared to the configuration of the laser scanning system, in which a laser beam is deflected and scanned by a rotating polygon mirror to form an electrostatic latent image, so that the size of the image forming apparatus is reduced and the manufacturing cost is decreased.

By the way, the exposure head is configured such that the wiring for transmitting the drive signal to drive the light-emitting portions works as an antenna so that the exposure head is likely to become a source of radiation noise. In contrast, Japanese Patent Application Laid-Open No. 2015-229246 describes the configuration in which the peak frequency gain of radiated noise components is suppressed by spreading the spectrum of the system clock using SSCG (Spread Spectrum Clock Generator) as a radiated noise countermeasure.

When the spread spectrum is used, the lighting time of the light-emitting portion may fluctuate due to the clock period variation, which may cause periodic unevenness in the image density. Therefore, the exposure head disclosed in Japanese Patent Application Laid-Open No. 2015-229246 is configured such that the phases of the modulation waveforms corresponding to the modulation periods are shifted from each other among multiple scanning lines to cancel the difference in the lighting time lengths of the light-emitting portions relative to the reference value among multiple scanning lines. This cancels out unevenness caused by fluctuations in the lighting time lengths of the light-emitting portions among multiple scanning lines, thereby suppressing periodic unevenness in image density.

However, in the configuration described in Japanese Patent Application Laid-Open No. 2015-229246, unevenness may occur in the image density in the sub-scanning direction depending on the image pattern and the phase of the modulation period. Hereinafter, this problem will be described with reference to the drawings.

FIG. 27A is a diagram showing the configuration of the exposure head 130 described in Japanese Patent Application Laid-Open No. 2015-229246. As shown in FIG. 27A, the exposure head 130 has twenty SLED (Self-Scanning Light Emitting Device) chips 131. The SLED chips 131 are arranged in a staggered manner along the main scanning direction.

FIG. 27B is a drawing showing the configuration of the SLED chip 131. As shown in FIG. 27B, the SLED chip 131 has 256 light-emitting portions 132 arranged along the main scanning direction. These light-emitting portions 132 are controlled by a drive portion (not shown) to be sequentially lighted up from the light-emitting portion 132 at the left end to the light-emitting section 132 at the right end, which are shown in FIG. 27B, with a scanning period corresponding to the resolution in the sub-scanning direction. In this way, in order to form a line image, the exposure head 130 performs scanning exposure using light emitted from a plurality of light-emitting portions 132 and forms scanning lines. The drive portion drives the light-emitting portions 132 such that the lighting of each light-emitting portion 132 is controlled using the modulated clock whose spectrum is spread by SSCG. The lighting control of the light-emitting portion 132 by the drive portion is described below using the figures.

FIG. 27C is a diagram showing the frequency modulation of the modulated clock and the scanning periods. In FIG. 27C, the scanning periods are indicated by Q1 and the modulated clock periods are indicated by Q2. The white circles shown in FIG. 27C indicate the points where the 43rd light-emitting portions portion 132 from the left end shown in FIG. 27B out of 256 light-emitting portions 132 emits light, that is, the points where ⅙ of the time of one period has advanced after the start of scanning one line. As shown in FIG. 27C, the drive portion controls the lighting such that the modulated clock period Q2 and the scanning period Q1 are shifted by $\pi/2$. When the drive portion controls the lighting in this way, the clock frequency fluctuations that affect the lighting time length of the light-emitting portion 132 are averaged over four scans, and the lighting time periods of the light-emitting portions 132 are averaged over four scanning lines (four lines). As a result, the accumulated light amounts are averaged.

FIG. 28A and FIG. 28B show a comparison between the image input to the image forming apparatus and the image output to the sheet by the image forming apparatus. The input images and output images shown in FIGS. 28A and 28B are images for four adjacent lines in the sub-scanning direction which are extracted from the line images that constitute a part of the entire image. The input images and output images shown in FIGS. 28A and 28B are formed by the pixels of the 41st to 45th light-emitting portions 132 (hereinafter referred to as light-emitting portions 132*a* to 132*e*) from the leftmost one in the direction from the leftmost one to the rightmost one shown in FIGS. 28A and 28B. That is, out of the pixels in the input images and output images shown in FIGS. 28A and 28B, the pixels at the left end of the main scanning direction are formed by the light-emitting portion 132*a*, and the pixels at the right end of the main scanning direction are formed by the light-emitting section 132*e*.

When images are formed at the (N+2)th and (N+3)th lines using the light-emitting portions 132*a* to 132*e*, the modulated clock frequency at the (N+2)th line is lower than that at the (N+3)th line. As a result, the lighting time is longer and the density of the output image is larger at the (N+2)th line than those at the (N+3)th line as shown in FIG. 28A. Therefore, when an image on the (N+2)th and an image on the (N+3)th line are viewed together, the densities are averaged so that the images on the (N+2)th and the (N+3)th lines are viewed the same as the input image.

However, depending on the image pattern, the densities of the images may not be well averaged as described above. When images are formed at the (N+1)th and (N+2)th lines using the light-emitting portions 132*a* to 132*e*, the frequency of the modulated clock is lower at both the (N+1)th and (N+2)th lines. As a result, the lighting time is longer and the density of the output image is larger at both the (N+1)th and (N+2)th lines as shown in FIG. 28B. Therefore, even when the output image for the (N+2)th and (N+3)th lines are viewed together, the densities are not well averaged to become closer to the input image, and the density of the output image becomes larger than that of the input image. Thus, unevenness in the densities of the output image may occur in the sub scanning direction depending on an image pattern.

SUMMARY OF THE INVENTION

A representative configuration of the present invention is an image forming apparatus, comprising:

a photosensitive drum configured to be rotatable;

a plurality of light-emitting portions arranged along a direction of a rotational axis of the photosensitive drum, the plurality of light-emitting portions being configured to emit light based on image data in order to expose the photosensitive drum;

a reference clock signal generation portion configured to generate a reference clock signal with a predetermined period;

a modulated clock signal generation portion configured to generate a modulated clock signal with a predetermined modulation period by spreading a spectrum of the reference clock signal and by modulating the predetermined period, wherein the plurality of light-emitting portions is configured to emit light for a lighting time set based on the modulated clock signal; and a control signal generation portion configured to generate with a period of n times the predetermined modulation period (n is an integer greater than or equal to 1) a control signal for controlling a timing at which the plurality of light-emitting portions emits light.

Further features of the present invention will become apparent from the following description of exemplary embodiments with reference to the attached drawings.

BRIEF DESCRIPTION OF THE DRAWINGS

FIG. 22 is diagram showing a pulse width table.

DESCRIPTION OF THE EMBODIMENTS

<Image Forming Apparatus>

Hereinafter, the overall configuration of the image forming apparatus A according to an example of an embodiment of the present invention will be described together with image forming operations with reference to the drawings. The dimensions, materials, shapes, and relative arrangements of the components described below are not intended to limit the scope of the present invention only to them unless otherwise specified.

The image forming apparatus A is a full-color image forming apparatus that forms an image by transferring four color toners (yellow Y, magenta M, cyan C, and black K) onto a sheet. In the following description, the subscripts Y, M, C, and K are generally added to the members that use the toners of respective colors. However, these subscripts are omitted as appropriate unless distinction is required since the configuration and operations of those members are substantially the same as each other except for the difference in color of the toner used.

Figure 1:
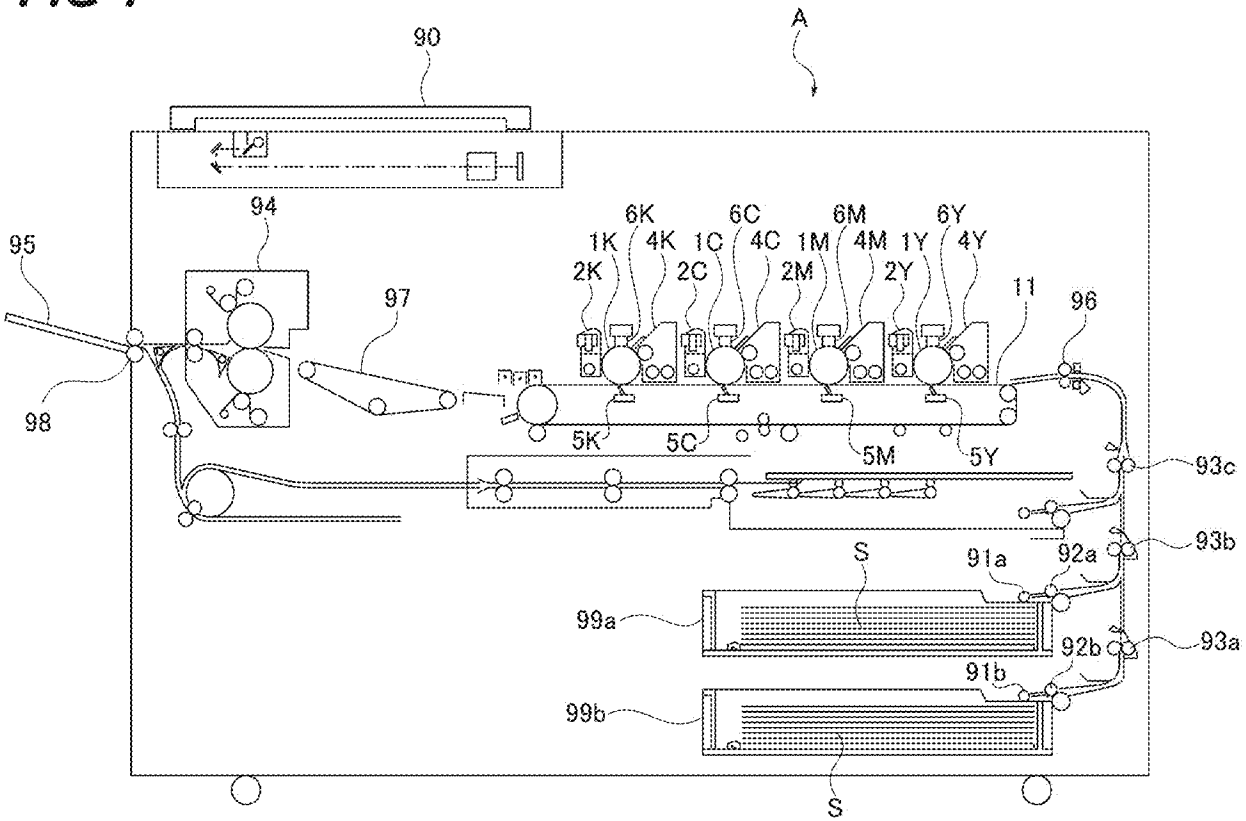
FIG. 1 is a diagram showing a schematic cross-sectional view of an image forming apparatus.

FIG. 1 is a schematic cross-sectional view of the image forming apparatus A. As shown in FIG. 1, the image forming apparatus A includes an image forming portion which forms an image on the sheet S. The image forming portion includes the rotatable photosensitive drums 1 (1Y, 1M, 1C, and 1K), the charging devices 2 (2Y, 2M, 2C, and 2K), exposure heads 6 (6Y, 6M, 6C, and 6K), developing devices 4 (4Y, 4M, 4C, and 4K) as developing portions, and the transfer devices 5 (5Y, 5M, 5C, and 5K).

When the photosensitive drum 1Y is designated as a first photosensitive drum, one of the photosensitive drums 1M, 1C, and 1K is designated as a second photosensitive drum. When the photosensitive drum 1M is designated as a first photosensitive drum, one of the photosensitive drums 1Y, 1C, and 1K is designated as a second photosensitive drum. Namely, when one of the photosensitive drums 1Y, 1M, 1C, and 1K is a first photosensitive drum, one of the other photosensitive drums is a second photosensitive drum. Similarly for exposure heads 6, when the exposure head 6Y is designated as a first exposure head, one of the exposure heads 6M, 6C, and 6K is designated as a second exposure head. Namely, when one of the exposure heads 6Y, 6M, 6C, and 6K is a first exposure head, one of the other exposure heads is a second exposure head.

Next, the image forming operations by the image forming apparatus A will be described. When forming an image, the sheet S accommodated in the sheet cassette 99*a* or 99*b* is first sent to the registration roller 96 by the pickup rollers 91*a* and 91*b*, the feed rollers 92*a* and 92*b*, and the conveying rollers 93*a* to 93*c*. Thereafter, the sheet S is sent to the conveying belt 11 at a predetermined timing by the registration roller 96.

On the other hand, in the image forming portion, the surface of the photosensitive drum 1Y is first charged by the charging device 2Y. Next, the exposure head 6Y irradiates the surface of the photosensitive drum 10Y with light in accordance with the image data read by the image reading portion 90 or the image data transmitted from an external device not shown in the figure) to form an electrostatic latent image on the surface of the photosensitive drum 10Y. Thereafter, the developing device 4Y attaches the yellow toner to the electrostatic latent image formed on the surface of the photosensitive drum 1Y to form a yellow toner image on the surface of the photosensitive drum 1Y. By applying a transfer bias to the transfer device 5Y, the toner image formed on the surface of the photosensitive drum 1Y is transferred to the sheet S that is being conveyed by the conveying belt 11.

By the same process, the photosensitive drums 1M, 1C, and 1K are irradiated with light by the exposure heads 6M, 6C, and 6K to form electrostatic latent images, and the magenta, cyan, and black toner images are respectively formed by the developing devices 4M, 4C, and 4K. Then, by applying transfer biases to the transfer devices 5M, 5C, and 5K, these toner images are superimposed onto the yellow toner image on the sheet S. As a result, a full-color toner image corresponding to the image data is formed on the surface of the sheet S.

After that, the sheet S bearing the toner image is conveyed by the conveying belt 97 to the fixing device 94 where it is heated and pressured. As a result, the toner image on the sheet S is fixed to the sheet S. After that, the sheet S on which the toner image is fixed is discharged by the discharge roller 98 to the discharge tray 95.

<Exposure Head>

Next, the configuration of the exposure head will be described.

Figure 2A:
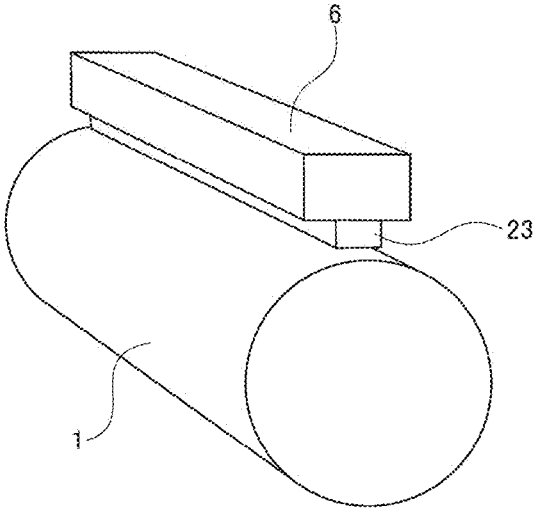
FIG. 2A is a diagram showing a perspective view of a photosensitive drum and an exposure head and FIG. 2B is a diagram showing a cross-sectional view of them.
Figure 2B:
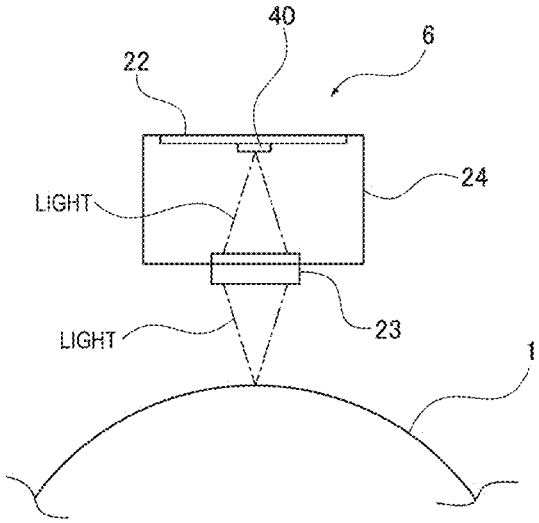
Figure 3A:
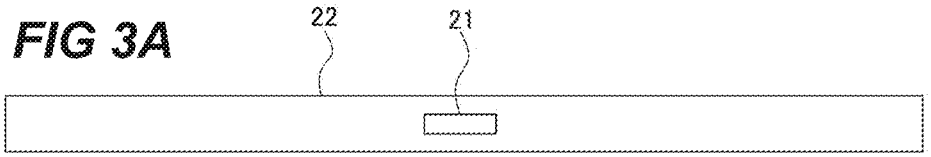
FIGS. 3A, 3B, and 3C show a mounting surface of a printed circuit board provided in the exposure head.
Figure 3B:
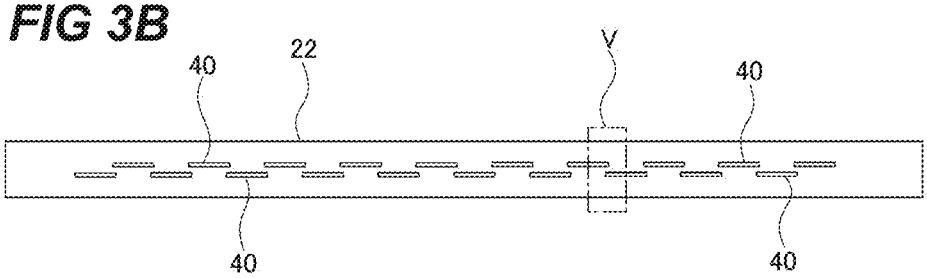
Figure 3C:
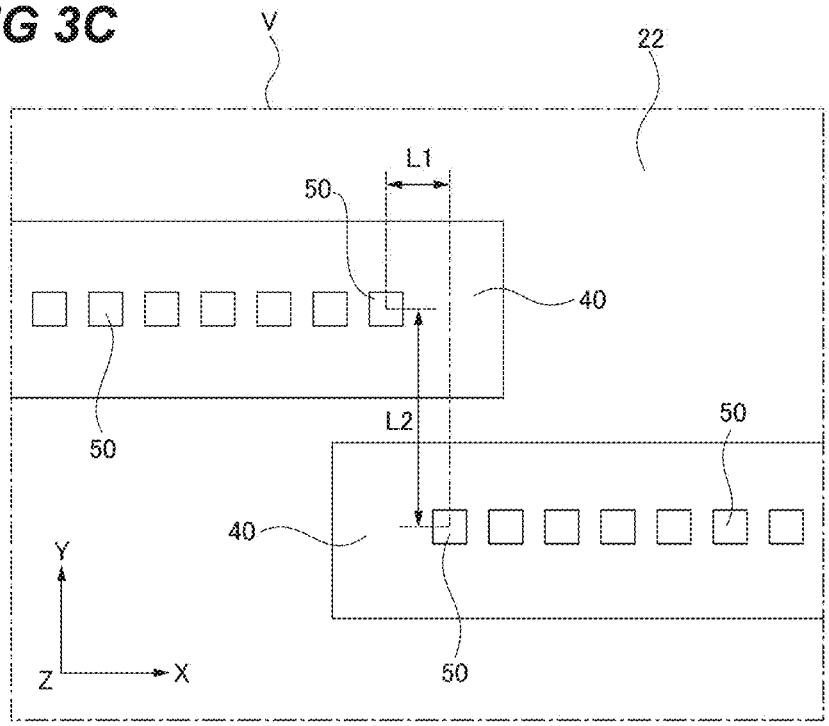

FIG. 2A shows a perspective view of the photosensitive drum 1 and the exposure head 6. FIG. 2B shows a cross-sectional view of the photosensitive drum 1 and the exposure head 6. FIG. 3A and FIG. 3B respectively show the mounting surfaces of one side and the other side of the printed circuit board 22 (second circuit board) provided in the exposure head 6. FIG. 3C shows an enlarged view of the area V shown in FIG. 3B.

As shown in FIGS. 2A and 2B, the exposure head 6 is fixed at a position facing the surface of the photosensitive drum 1 by a fixing member (not shown). The exposure head 6 includes the printed circuit board 22, the light-emitting element array chips 40 for emitting light mounted on the printed circuit board 22, the rod lens array 23 that images (focuses) the light emitted from the light emitting element array chips 40 onto the photosensitive drum 1, and the housing 24 to which the rod lens array 23 and the printed circuit board 22 are fixed.

The connector 21 is mounted on the surface of the side of the printed circuit board 22 opposite to the surface on which the light-emitting element array chips are 40 are mounted. The connector 21 is provided to transmit control signals for the light emitting element array chips 40, which are transmitted from the image controller portion 70 (FIG. 7) and to connect the power supply line. The light-emitting element array chips 40 are driven via the connector 21.

Figure 20:
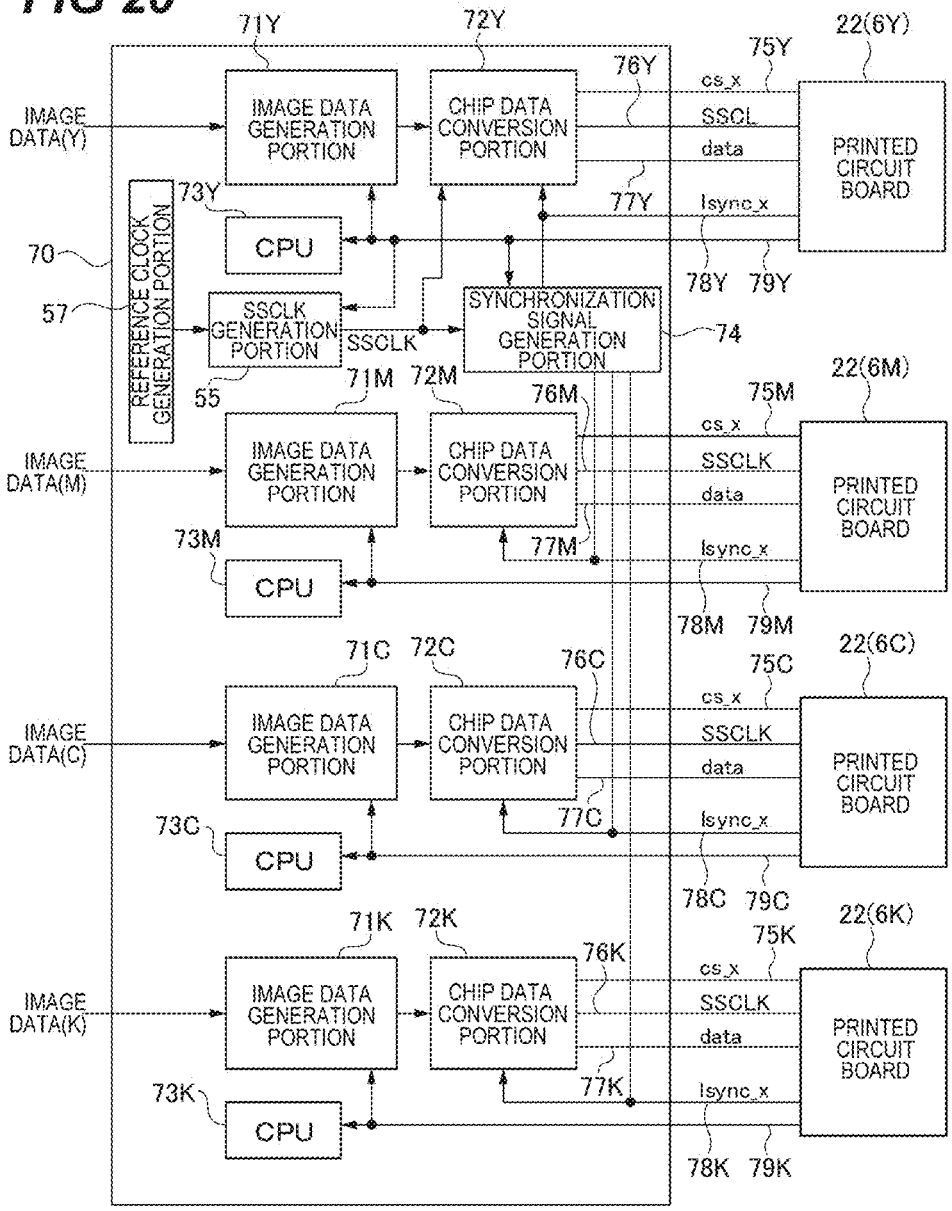
FIG. 20 is a block diagram showing the configuration of an image controller portion.

As shown in FIG. 3B, 20 light-emitting element array chips 40 are mounted on the printed circuit board 22 in a staggered manner in double-row arrangement. In each light-emitting element array chip 40, 748 light-emitting portions 50 are arranged in the longitudinal direction (in the direction of the arrow X) in a predetermined resolution pitch. A light-emitting portion refers to a light-emitting area corresponding to one resolution. The light-emitting portion is not limited to the configuration formed by a light-emitting layer using an Organic Electro-Luminescence layer as in this embodiment. For example, when a light-emitting diode is used instead of a light-emitting layer, one light-emitting portion corresponds to one light-emitting diode element.

In this embodiment, the above resolution pitch of the light-emitting element array chip 40 is 1200 dpi (about 21.16 μm). The distance from one end to the other end of 748 light-emitting portions 50 in the longitudinal direction of each light-emitting element array chip 40 is about 15.8 mm. In other words, the exposure head 6 has a total of 14960 light-emitting portions 50 in the direction of the arrow X. This makes it possible to perform an exposure process for an image with the width of approximately 316 mm (which is approximately 15.8 mm×20 chips) in the longitudinal direction.

In the longitudinal direction of the light-emitting element array chip 40, the interval L1 between the light-emitting portions 50 of the adjacent light-emitting element array chips 40 is approximately 21.16 μm. In other words, the pitch of the light-emitting portions 50 in the longitudinal direction at the boundary of the light-emitting element array chips 40 adjacent to each other is 1200 dpi resolution. In the width direction (the direction of the arrow Y) of the light-emitting element array chip 40, the interval L2 between the light-emitting portions 50 of the light-emitting element array chips 40 disposed in two rows is approximately 105 μm (equivalent to five pixels at 1200 dpi and ten pixels at 2400 dpi).

In this embodiment, the direction of the arrow X, which is the longitudinal direction of the light emitting element array chip 40, is the direction of the rotational axis of the photosensitive drum 1, and the direction of the arrow Y, which is the width direction of the light-emitting element array chip 40, is the rotational direction of the photosensitive drum 1. The direction of the arrow Z is the layered direction where layers of the layered structure of the light-emitting portion 50 described below are piled on each other. The longitudinal direction of the light-emitting element array chip 40 may be inclined by about ±1° to the direction of the rotational axis of the photosensitive drum 1. The width direction of the light-emitting element array chip 40 may also be inclined about ±1° to the rotational direction of the photosensitive drum 1.

<Light-Emitting Element Array Chip>

Next, the configuration of the light-emitting element array chip 40 will be described.

Figure 4:
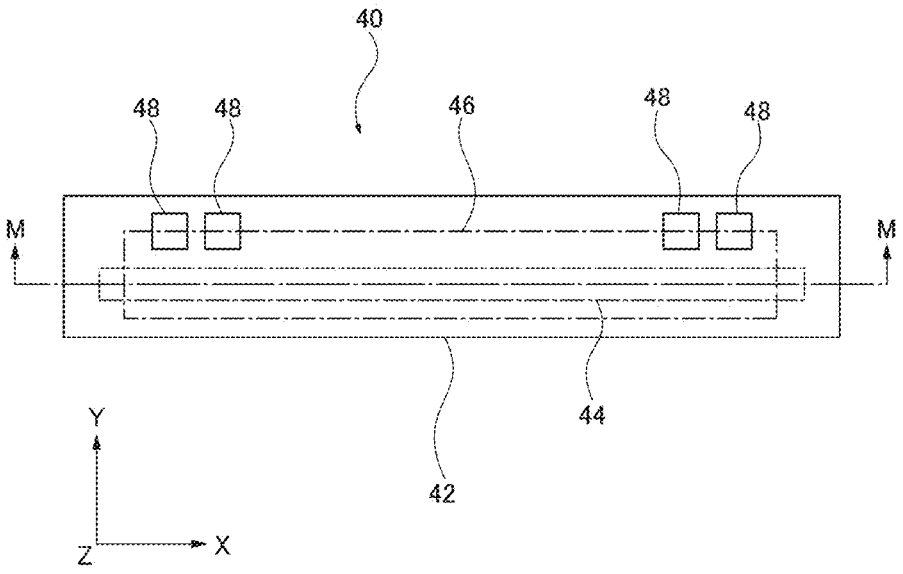
FIG. 4 is a schematic diagram of a light-emitting element array chip.
Figure 5:
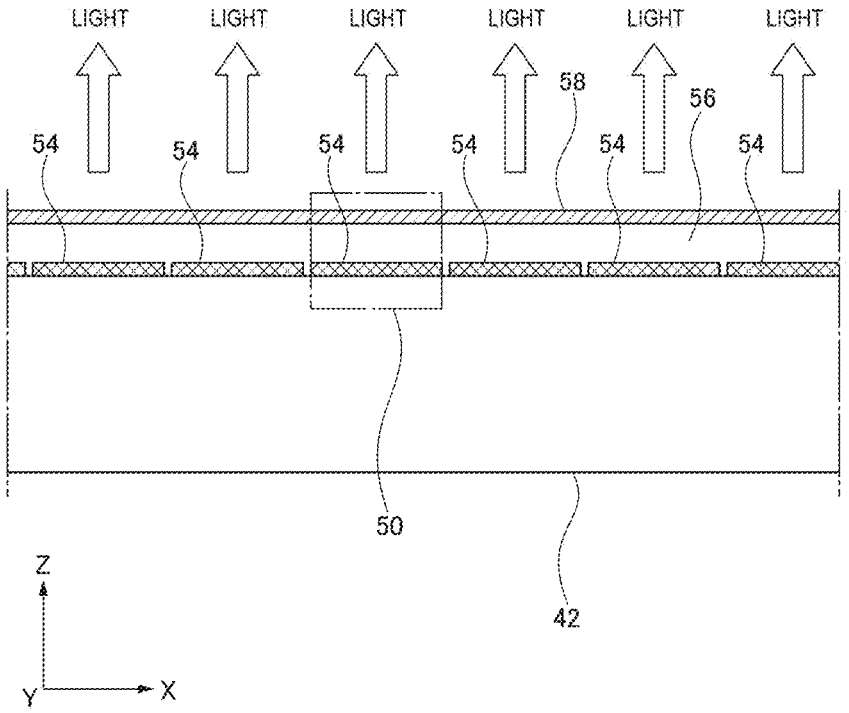
FIG. 5 is a diagram showing a cross-sectional view of the light-emitting element array chip.
Figure 6:
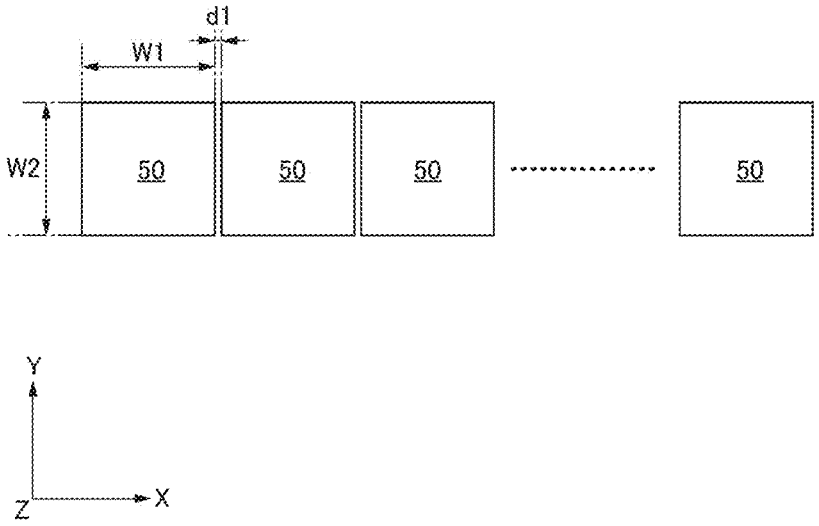
FIG. 6 is a schematic diagram for describing the arrangement of the light-emitting portions.

FIG. 4 shows a schematic view of the light-emitting element array chip 40. FIG. 5 shows a cross-sectional view cut at the M-M cross-section shown in FIG. 4. FIG. 6 is a schematic diagram for describing the arrangement of the light-emitting portions 50.

As shown in FIG. 4, the light-emitting element array chip 40 has the light-emitting substrate 42 (first circuit board) with the built-in circuit portion 46 for controlling the light-emitting portions 50, the light-emitting area 44 where a plurality of light-emitting portions 50 are regularly arranged on the light-emitting substrate 42, and the wire-bonding pads 48. The signal input and output between the outside of the light-emitting element array chip 40 and the circuit portion 46 and the power supply to the circuit portion 46 are performed via the wire-bonding pads 48. The circuit portion 46 may include an analog drive circuit, a digital control circuit, or a circuit with an analog drive circuit and a digital control circuit.

As shown in FIG. 5, the light-emitting portions 50 include the light-emitting substrate 42, the lower electrodes 54 arranged in a two-dimensional array on the light-emitting substrate 42 at a certain interval in the direction of the arrow X (an interval d1 shown in FIG. 6), the light-emitting layer 56, and the upper electrode 58.

The lower electrodes 54 (the first electrode layer having a plurality of electrodes) are formed in a separated manner on the light-emitting substrate 42 as a layer and are respectively provided for pixels. In other words, each of the lower electrodes 54 is provided to form one pixel each.

The upper electrode 58 (second electrode layer) is stacked on the side of the light-emitting layer 56 opposite to the side where the lower electrodes 54 are provided. The light with the wavelength emitted from the light-emitting layer 56 is transmissible through the upper electrode 58.

Figure 7:
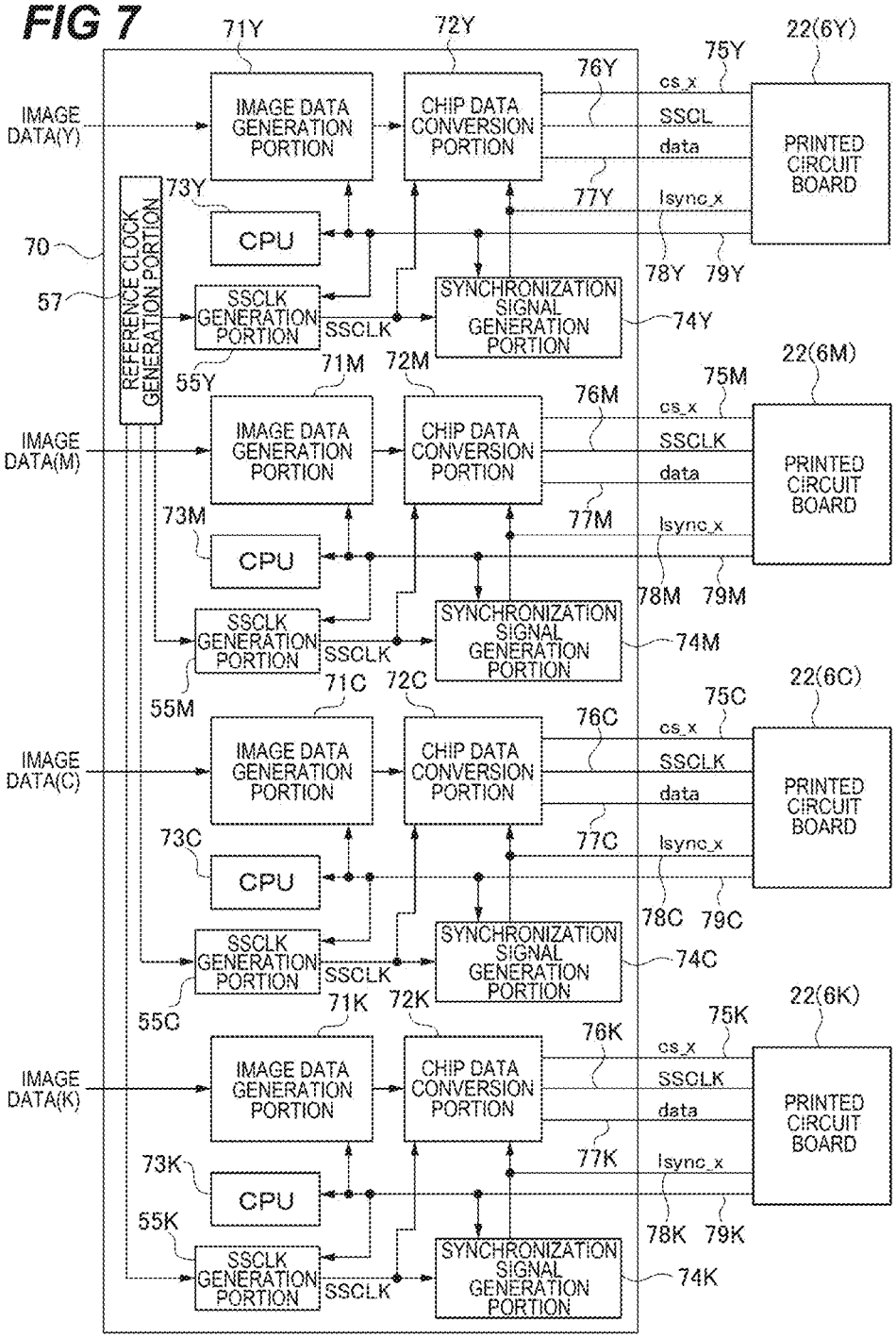
FIG. 7 is a block diagram showing the configuration of an image controller portion.

The circuit portion 46 (drive portion) lights the light-emitting portions 50 based on various control signals generated according to image data by the image controller portion 70 shown in FIG. 7. Specifically, the circuit portion 46 controls the potential of the lower electrode 54 selected based on a control signal generated according to the image data, and produces a potential difference between the selected lower electrode 54 and the upper electrode 58. When a potential difference occurs between the upper electrode 58, which is the anode, and the lower electrode 54, which is the cathode, electrons flow into the light-emitting layer 56 from the cathode and positive holes flow into the light-emitting layer 56 from the anode. The recombination of electrons and positive holes in the light-emitting layer 56 causes the light-emitting layer 56 to emit light.

The light emitted from the light-emitting layer 56 toward the upper electrode 58 transmits through the upper electrode 58 and exits from the upper electrode 58. The light emitted from the light-emitting layer 56 toward the lower electrode 54 is reflected from the lower electrode 54 to the upper electrode 58, and the reflected light also transmits the upper electrode 58 and exits from the upper electrode 58. In this way, the light exits from the light-emitting portion 50. There is a time difference in the exit timing between the light emitted directly from the light-emitting layer 56 toward the upper electrode 58 and the light reflected from the lower electrode 54 and exits from the upper electrode 58. However, the layer of the light-emitting portion 50 is extremely thin, so that the exit of the direct light and the exit of the reflected light may be regarded as almost simultaneous.

In this embodiment, the light-emitting substrate 42 is made of silicon. The upper electrode 58 is preferred to be transparent for the light with the wavelength emitted from the light-emitting layer 56. For example, a transparent electrode such as an electrode made from Indium Tin Oxide (ITO) may be used to achieve an aperture ratio of substantially 100%, so that the light emitted by the light-emitting layer 56 transmits the upper electrode 58 and exits from the upper electrode 58 as it is. In this embodiment, the upper electrode 58 is an anode commonly provided for all of the lower electrodes 54. However, upper electrodes 58 may be provided such that these upper electrodes 58 respectively correspond to the lower electrodes 54 or each of the upper electrodes 58 corresponds to several of the lower electrodes 54.

As the light-emitting layer 56, an organic Electro-Luminescence (EL) film or an inorganic Electro-Luminescence (EL) layer can be used. When an organic EL film is used as the light-emitting layer 56, the light-emitting layer 56 may be a stacked structure that includes functional layers such as an electron transport layer, a positive hole transport layer, an electron injection layer, a positive hole injection layer, an electron blocking layer, and a positive hole blocking layer as necessary. The light-emitting layer 56 may be formed continuously in the direction of the arrow X, or the separate light-emitting layers 56 may be formed each of which has the same size as that of the lower electrodes 54. Further, all of the lower electrodes 54 may be divided into a plurality of groups, and the light-emitting layers 56 may be provided such that each of the light-emitting layers 56 is stacked on the upper surfaces of the lower electrodes 54 which belong to one of the divided groups.

When using moisture-sensitive light-emitting materials such as an organic EL layer or an inorganic EL layer as the light-emitting layer 56, it is desirable to seal the light-emitting area 44 to prevent moisture from entering. For sealing, a sealing film is formed which includes a single layer or stacked layers of a thin film of, for example, silicon oxide, silicon nitride, or aluminum oxide. For forming a sealing film, methods such as Atomic Layer Deposition (ALD) method are preferable that excel in covering a structure such as steps. The materials, configuration, and forming method of the sealing film are not limited to the above-described examples, and suitable ones may be selected as needed.

The lower electrode 54 is preferably made of a metal that has high reflectivity for light with the wavelength emitted from the light-emitting layer 56. For example, Ag, Al, or an alloy of Ag and Al is used as the lower electrode 54. The lower electrode 54 and the circuit portion 46 are formed using the Si process, and the lower electrode 54 is directly connected to the driving portion of the circuit portion 46. By forming the lower electrodes 54 by the Si process, the lower electrodes 54 can be precisely and densely arranged since the process rule is highly precise at about 0.2 μm. Furthermore, since the lower electrodes 54 can be arranged in high density, most of the light-emitting area 44 can emit light, and the utilization efficiency of the light-emitting area 44 can be increased. The organic material of the light-emitting layer 56 is filled between the lower electrodes 54, so that the lower electrodes 54 are separated from each other by the organic material.

In the stage before the product is shipped from the factory, the light amount adjustment is performed in which the lower electrode 54 is driven and the light amount is adjusted by adjusting the voltage applied to the lower electrode 54 such that the light amount focused on the photosensitive drum 1 through the rod lens array 23 reaches a predetermined light amount. In addition to the above-described light amount adjustment, the focus adjustment is performed in which the distance between the light-emitting element array chip 40 and the rod lens array 24 is adjusted.

As shown in FIG. 6, the light-emitting portions 50 are arranged in the light-emitting area 44 with a predetermined interval in the direction of the arrow X. In this embodiment, the width W1 of the light-emitting portion 50 in the direction of the arrow X is 20.90 μm, and the distance d1 between adjacent light-emitting portions 50 in the direction of the arrow X is 0.26 That is, the light-emitting portions 50 are arranged with a pitch of 21.16 μm (1200 dpi) in the direction of the arrow X. The width W2 of the light-emitting portion 50 in the direction of the arrow Y is 20.90 which is equal to the width W1. That is, the light-emitting portion 50 of this embodiment has a square shape with one edge of 20.90 μm and an area of 436.81 $\mu m^2$, which occupies about 97.6% of the area of 447.7456 $\mu m^2$, which correspond to one pixel. The light amount obtained by organic light-emitting materials is lower than that by LEDs. However, by forming the light-emitting portion 50 as a square shape and decreasing the distance between adjacent light-emitting portions 50 as described above, it is possible to ensure a light emitting area enough for obtaining the light amount which can change the potential of the photosensitive drum 1.

It is desirable to ensure that the area of the light-emitting portion 50 is 90% or more of the area occupied by one pixel. Therefore, for an image forming apparatus A with an output resolution of 1200 dpi, it is desirable to form the light emitting portion 50 with its edge being about 20.07 μm or more. Further, for an image forming apparatus A with an output resolution of 2400 dpi, it is desirable to form the light emitting portion 50 with its edge being about 10.04 μm or more. The shape of the light-emitting portion 50 is not limited to a square. A polygon with more than four angles, a circle, an oval can be adopted as long as it emits light with an exposure area size corresponding to the output resolution of the image forming apparatus A and the quality of output images meets the design specifications of the image forming apparatus A. The distance d2 between adjacent light-emitting portions 50 in the direction of the arrow Y and the number of rows of light-emitting portions 50 in the direction of the arrow Y are determined based on the scanning speed of the exposure head 6, the amount of light required for the exposure process, and the resolution.

<System Configuration of Exposure Head>

Next, the configuration of the exposure head 6 and the image controller portion 70 that controls the exposure head 6 will be described. The image controller portion 70 is provided on the main body of the image forming apparatus A.

Figure 8:
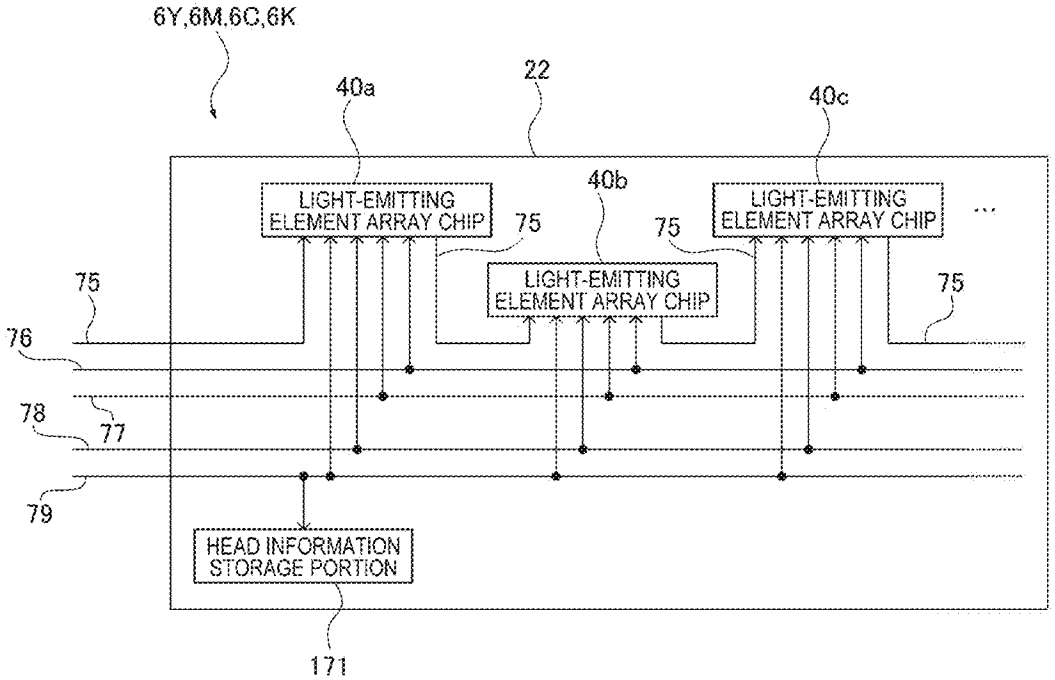
FIG. 8 is a block diagram showing the configuration of the exposure head.

FIG. 7 is a block diagram of the system configuration of the image controller portion 70. FIG. 8 is a block diagram of the system configuration of the exposure head 6. As shown in FIG. 7, the image controller portion 70 includes the image data generation portions 71 (71Y, 71M, 71C, and 71K), the chip data conversion portions 72 (72Y, 72M, 72C, and 72K), and the CPUs 73 (73Y, 73M, 73C, and 73K). In this embodiment, one CPU 73 is provided for each color, however, the single CPU 73 may be used to control the exposure heads 6 for all colors.

The image controller portion 70 includes the synchronization signal generation portions 74 (74Y, 74M, 74C, and 74K), the reference clock generation portion (reference clock signal generation portion) 57, and the SSCLK generation portions (modulated clock signal generation portions) 55 (55Y, 55M, 55C, and 55K). In this embodiment, a reference clock is supplied from one reference clock generation portion 57 to all of the SSCLK generation portions 55 (55Y, 55M, 55C, and 55K) corresponding to all colors, but the invention is not limited to this configuration. For example, the configuration may be adopted in which a reference clock is supplied to one SSCLK generation portion from one reference clock generation portion and a modulated clock is supplied to each of the synchronization signal generation portions 74 (74Y, 74M, 74C, and 74K) corresponding to each color and each of the chip data conversion portions 72 (72Y, 72M, 72C, and 72K) corresponding to each color. Namely, it is not necessary to provide four SSCLK generation portions corresponding to respective colors and it is sufficient to provide a single SSCLK generation portion. Further, the configuration may be adopted in which four reference clock generation portions are provided corresponding to respective colors, and four SSCLK generation portions are provided corresponding to the four reference clock generation portions.

With these parts, the image controller portion 70 processes image data, generates image formation timing, and sends control signals to control the exposure heads 6Y, 6M, 6C, and 6K. Since these parts perform the same processing in parallel for four image data corresponding to yellow, magenta, cyan, and black when performing image formation operations, suffixes are omitted as appropriate in the following description. Likewise, since various signals are input to the exposure heads 6Y to 6K from the image controller portion 70 and the same processing is performed in each of the exposure heads 6Y to 6K, suffixes are omitted as appropriate in the following description.

The image data generation portion 71 receives the image data of a document read by the image reading portion 90 or image data transferred from an external device via the network. The image data generation portion 71 dithers the input image data at the resolution instructed by the CPU 73, and generates image data for outputting images.

The reference clock generation portion 57 generates a reference clock (reference clock signal), which is a signal with a predetermined period. In this embodiment, the reference clock is a signal that is repeatedly turned on and off at a frequency of 100 MHz. Thus, the predetermined period is 1/100M (sec). The SSCLK generation portion 55 (modulated clock generation portion) is configured by a spread spectrum clock IC (SSCG: Spread Spectrum Clock Generator). The SSCLK generation portion 55 performs frequency modulation (spread spectrum) processing on the reference clock generated by the reference clock generation portion 57, and modulates the reference clock such that the reference clock has a predetermined period. The modulated signal is referred to as a modulated clock (modulated clock signal). Namely, the modulated clock is a signal generated based on the reference clock, and has a predetermined modulation period. This modulated clock is referred to as "SSCLK" in the drawing. The CPU 73 sets a modulation period (a predetermined modulation period) and intensity of the modulation of the modulated clock generated by the SSCLK generation portion 55.

The synchronization signal generation portion 74 (control signal generation portion) periodically generates a line synchronization signal (control signal) that represents the separation of each line of the image data in the main scanning direction. The CPU 73 informs the synchronization signal generation portion 74 of the time interval of the one-line signal period. The one-line signal period is determined as the period in which the surface of the photosensitive drum 1 moves for a pixel size of 1200 dpi in the direction of rotation as one line period based on the preset rotation speed of the photosensitive drum 1. For example, if the photosensitive drum 1 rotates at 200 mm/s, the CPU informs of the time interval of 105.8 μs as one line period.

Figure 9:
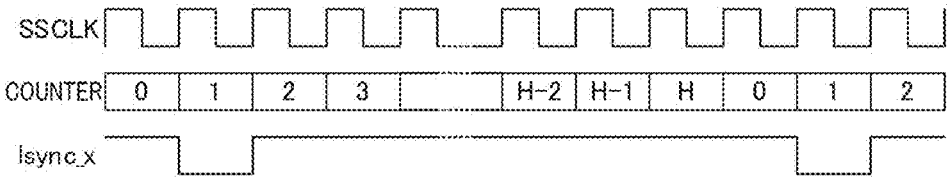
FIG. 9 is a timing chart of input and output signals of the synchronization signal generation portion.

Specifically, the setting of the time interval of one line period is performed based on number of clock counts. Namely, the synchronization signal generation portion 74 counts the input modulation clock generated by the SSCLK generation portion 55. Then, the synchronization signal generation portion 74 generates a pulse when the counted modulated clock is compared with the value indicated by the CPU 73. In order to perform this, as shown in FIG. 9, the synchronization signal generation portion 74 has a counter that counts up according to the modulated clock input from the SSCLK generation portion 55. The counter is cleared to the value 0 when the count value becomes equal to the value H indicated by the CPU 73. In other words, the synchronization signal generation portion 74 counts the modulation clock and periodically generates a line synchronization signal, which is a control signal that controls the timing at which the light-emitting portions 50 selected according to the image data start to emit light when forming an electrostatic latent image for one line in the main scanning direction. As described above, the light-emitting portions 50 start emitting light at the timing at which the counter counts by a predetermined number. The configuration may be adopted in which the CPU 73 indicates the synchronization signal generation portion 74 to generate a line synchronization signal. Further, the configuration may be adopted in which the predetermined value is stored in a memory, and the synchronizing signal generation portion 74 generates a line synchronization signal in response to the count value of the counter reaching the predetermined value without any indication from the CPU 73.

The chip data conversion portion 72 divides the image data for one line into the number of the light-emitting element array chips 40 in synchronization with the line synchronization signal generated by the synchronization signal generator 74 and input via the line synchronization signal line 78. The chip data conversion portion 72 then transmits the image data for one line along with the clock signal and a chip selection signal representing the effective ranges of image data to the light-emitting element array chips 40 via the chip selection signal line 75, the clock signal line 76 and the image data signal line 77.

The head information storage portions 171 provided in the exposure heads 6Y, 6M, 6C, and 6K are respectively connected to the CPUs 73Y, 73M, 73C, and 73K via the communication signal lines 79. The head information storage portions 171 store the amount of light emitted by the light-emitting element array chips 40 and the mounting position information as head information. The light-emitting element array chips 40 light the light-emitting portions 50 based on the set values of the signals input from the image controller portion 70.

Each light-emitting element array chip 40 of one exposure head 6 is connected in cascade with other light-emitting element array chips 40 via the chip selection signal lines 75. For convenience of description, the light-emitting element array chips 40 shown in FIG. 8 are referred to as the light-emitting element array chip 40*a* to the light-emitting element array chip 40*c* in the order in which they are connected by the chip selection signal lines 75 from the chip data conversion portion 72. Each light-emitting element array chip 40 generates a chip selection signal used by another light emitting device array chip 40 and transmits it via the chip selection signal line 75. For example, the light-emitting element array chip 40*a* generates a chip selection signal to be used by the light-emitting element array chip 40*b* and transmits it via the chip selection signal line 75. Similarly, the light-emitting element array chip 40*b* generates a chip selection signal to be used by the light-emitting element array chip 40*c* and transmits it via the chip selection signal line 75. In this way, each of 20 light-emitting element array chips 40 provided by one exposure head 6 generates a chip selection signal and transmits it to another light-emitting element array chip 40 via the chip selection signal line 75.

<System Configuration of Light-Emitting Device Array Chip>

Next, the system configuration of the light-emitting element array chip 40 will be described.

Figure 10:
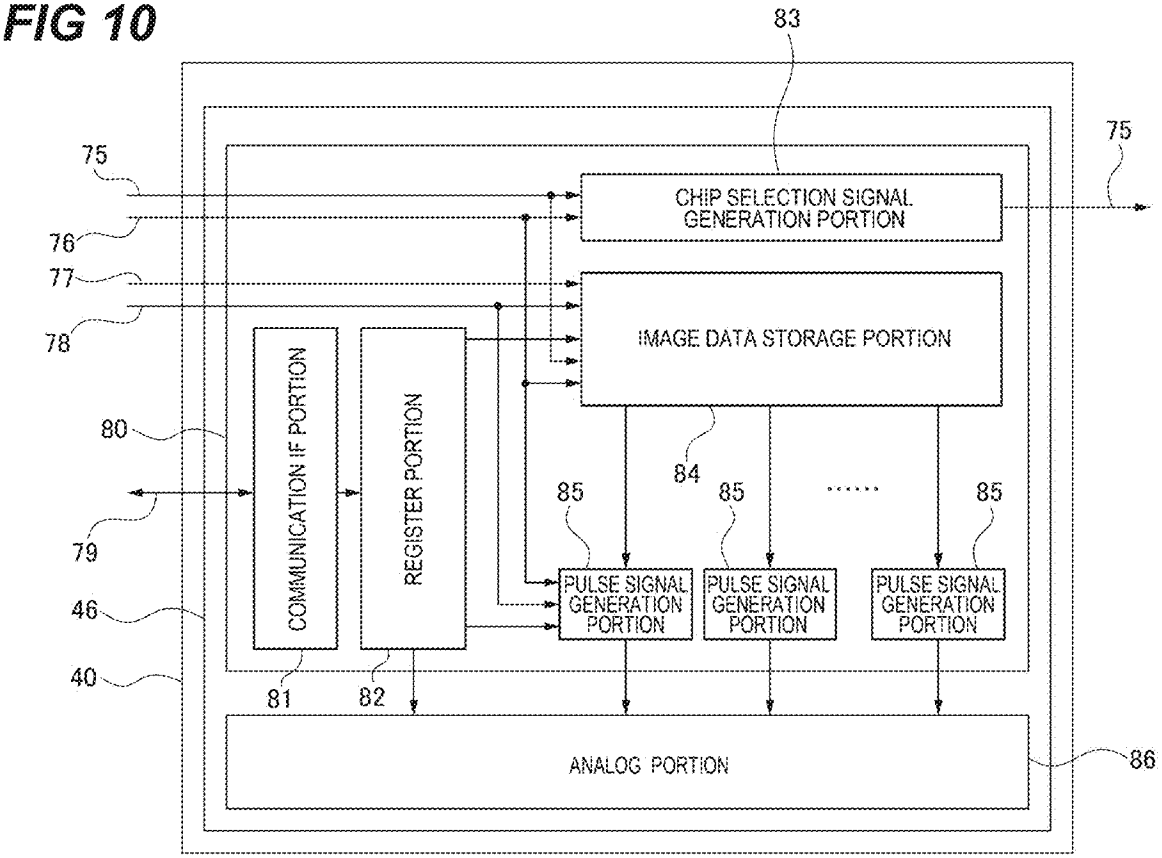
FIG. 10 is a block diagram showing the system configuration of the light-emitting element array chip.

FIG. 10 is a block diagram showing the system configuration of the light-emitting element array chip 40. As shown in FIG. 10, the circuit portion 46 of the light-emitting element array chip 40 includes the digital portion 80 and the analog portion 86. The analog portion 86 generates a signal for driving the light-emitting portions 50 based on pulse signals generated by the digital section 80 as described below.

The digital portion 80 includes the communication IF (interface) portion 81, the register portion 82, the chip selection signal generation portion 83, the image data storage portion 84, and the pulse signal generation portion 85 (*t*). With these parts, the digital portion 80 generates and transmits to the analog portion 86 pulse signals for lighting the light-emitting portions 50 based on the setting values preset by a communication signal in synchronization with the modulated clock signal, a chip selection signal, an image data signal, and a line synchronization signal.

The chip selection signal generation portion 83 delays the input chip selection signal and generates a chip selection signal used by other light-emitting element array chip 40 connected via the chip selection signal line 75.

The register portion 82 stores the exposure timing information used by the image data storage portion 84, the pulse signal width information and the pulse signal phase information (delay information) generated by the pulse signal generation portion 85, and the drive current setting information set by the analog portion 86. The communication IF portion 81 controls the writing and reading of set values to and from the register portion 82 based on the communication signal input by the CPU 73.

The image data storage portion 84 holds the image data while the input chip selection signal is valid, and simultaneously outputs all the image data of the light-emitting portions 50 that the light-emitting element array chip 40 includes to the pulse signal generation portion 85 in synchronization with the line synchronization signal. The pulse signal generation portion 85 generates and outputs to the analog portion 86 a pulse signal for controlling the timing to turn on the light-emitting portion 50 based on the pulse signal width information and the pulse signal phase information set in the register portion 82 according to the image data input from the image data storage portion 84.

<Image Data Storage Portion>

Next, the operations of the image data storage portion 84 will be described. In the following description, the chip selection signal cs and the line synchronization signal lsync are expressed as negative logic signals. However, these signals may be expressed as positive logic signals.

Figure 11:
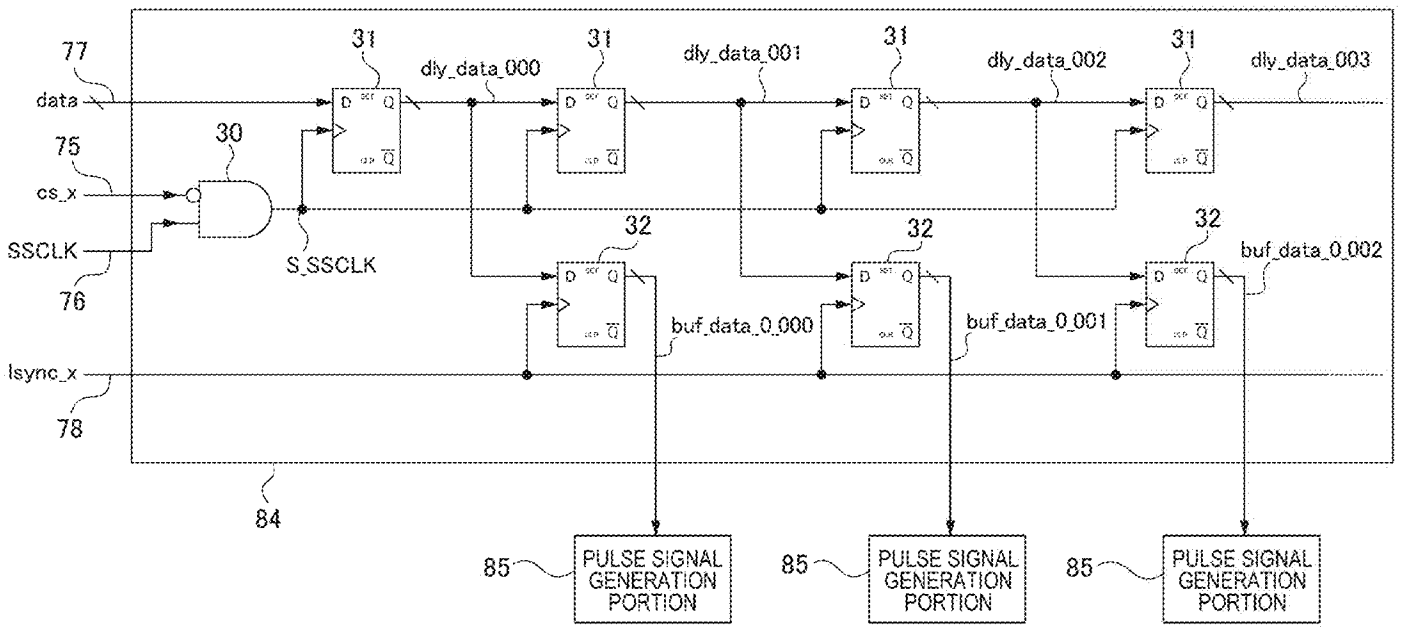
FIG. 11 is a circuit diagram of an image data storage portion.

FIG. 11 is a diagram showing the circuit configuration of the image data storage portion 84. As shown in FIG. 11, the clock gate circuit 30 outputs the logical product of the inverted signal of the chip selection signal cs and the modulated clock signal SSCLK, thereby outputting the clock signal s SSCLK to the flip-flop circuit 31 only when the chip selection signal cs is valid. The image data storage portion 84 includes the same number (which is 748) of the flip-flop circuits 31 which are connected in series as that of the light-emitting portions 50 provided in the longitudinal direction of the light-emitting element array chip 40. The image data signal data input to the image data storage portion 84 is input to the first one of the series-connected flip-flop circuits 31.

The flip-flop circuits 31 operate based on the clock signal s SSCLK sent from the clock gate circuit 30. The output signals of the flip-flop circuits 31 are respectively input to the flip-flop circuits 32, and the flip-flop circuits 32 operate based on the line synchronization signal lsync. The output signals of the flip-flop circuits 32 are input to the pulse signal generation portions 85 as image data buf_data_0_000 to buf_data_0_747.

Figure 12:
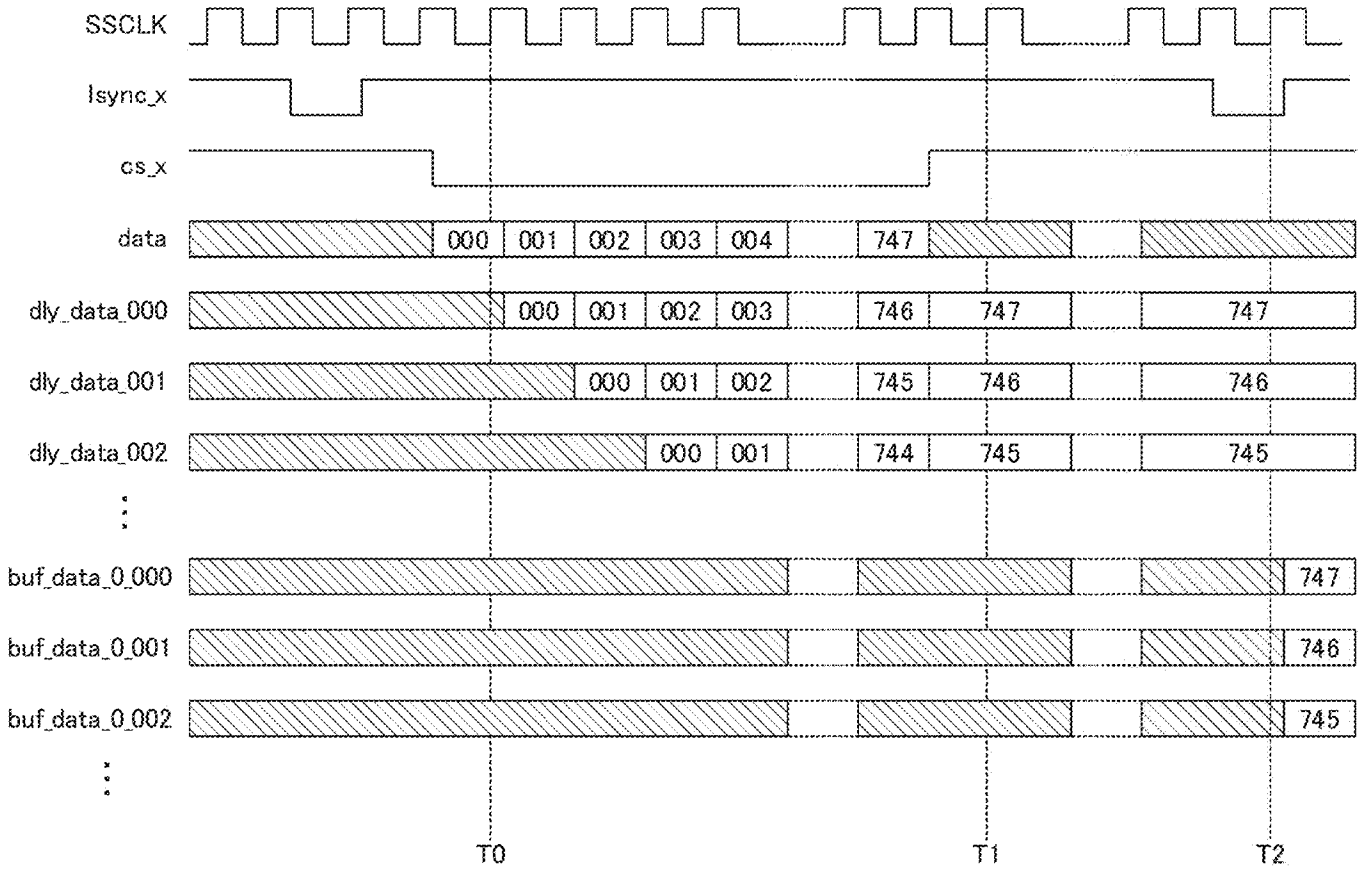
FIG. 12 is a timing chart of the image data storage portion.

FIG. 12 is a timing chart showing the operations in the image data storage portion 84. The meanings of symbols shown in FIG. 12 are the same as those shown in FIG. 11. As shown in FIG. 12, during the period from the time T0 when the chip selection signal cs is detected such that the value of the signal cs=0 at a leading edge of the clock signal SSCLK and to the time T1, the image data signal is shifted in the order of data→dly_data_000→dly_data_001. The same number (which is 748) of clock pulses whose value of the signal cs=0 as the number of the light-emitting portions 50 are input. As a result, image data for one line as dly_data_000 to dly_data_747 are stored.

After the time T1, the shift operation of the image data is not performed while the image data are held since the value of the chip selection signal cs=1. After the line synchronization signal lsync is detected such that the value of the signal lsync=0 at a leading edge of the clock signal SSCLK at the time T2, the image data for one line in the main scanning direction is simultaneously output like dly_data_000→buf_data_0_000, dly_data_001→buf_data_0_001 to the pulse signal generation portions 85 as the signals buf_data_0_000 to buf_data_0_747.

<Pulse Signal Generation Portion>

Next, the pulse signal generation portions 85 will be described. The same number (748) pulse signal generation portions 85 are provided as that of the light-emitting portions 50 that each light-emitting element array chip has. However, their structures are the same as each other, so the structure of one pulse signal generation portion will be described.

Figures 13A, 13B:
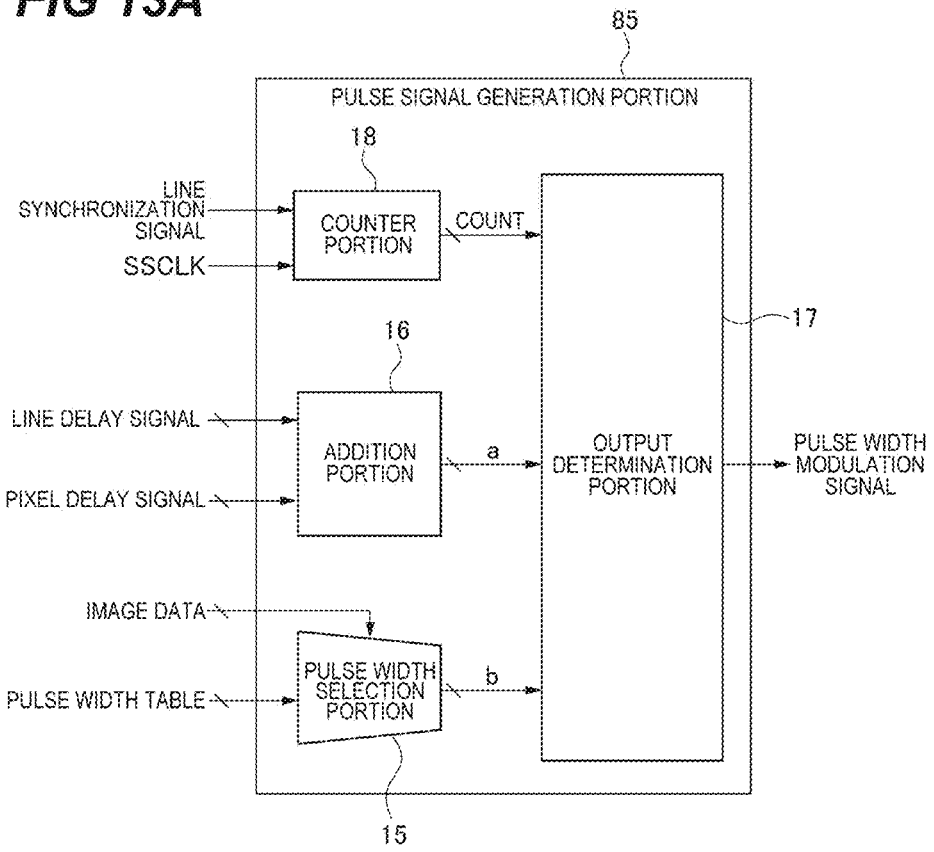
FIG. 13A is a block diagram of a pulse signal generation portion and FIG. 13B is a pulse width table.
Figure 14:
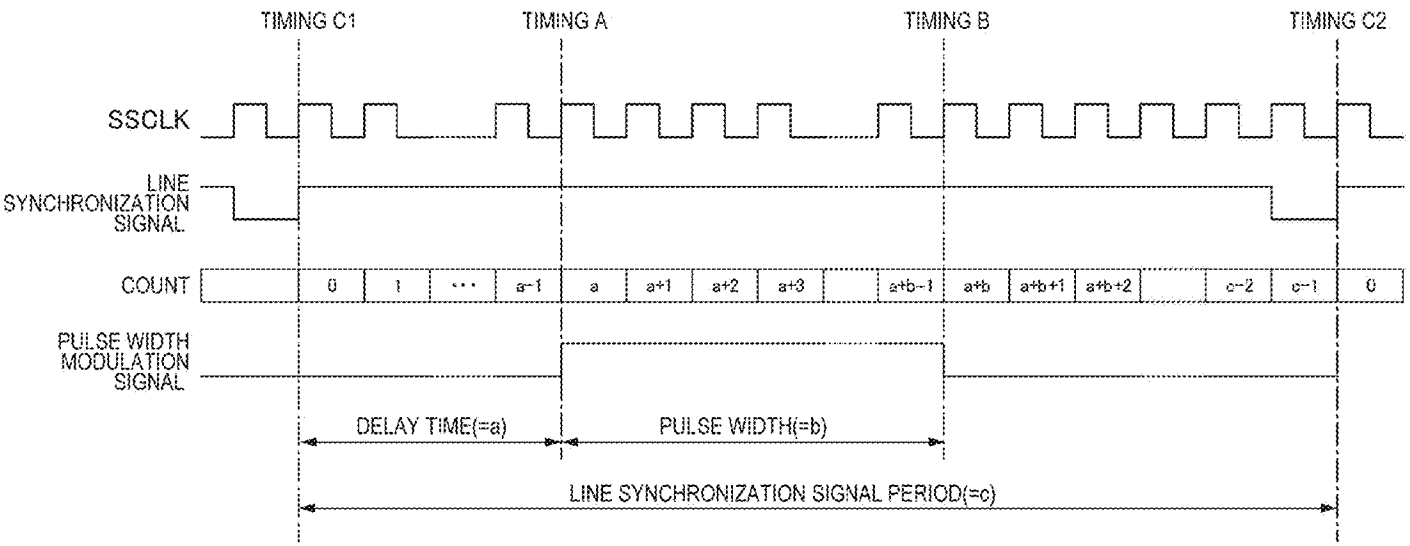
FIG. 14 is a timing chart showing the operational timing of the pulse signal generation portion.

FIG. 13A is a block diagram of the pulse signal generation portion 85. FIG. 13B is a drawing showing a pulse width table stored in the register portion 82. FIG. 14 is a timing chart showing the operational timing of the pulse signal generation portion 85. As shown in FIG. 13A, the pulse signal generation portion 85 has the pulse width selection portion 15, the addition portion 16, the output determination portion 17, and the counter portion 18.

The pulse width selection portion 15 determines the pulse width b of the pulse signal by selecting from the pulse width table shown in FIG. 13B the value corresponding to the image data input from the image data storage portion 84. The addition portion 16 adds a line delay signal, which is common to all pulse signal generation portions 85, and pixel delay signals, which are different from each other for the respective pulse signal generation portions 85, to determine the delay time a of the pulse signal.

The counter portion 18 counts the modulated clock and resets the count for each line synchronization signal period c. In other words, the counter portion 18 resets the count at the timing C1 and the timing C2 shown in FIG. 14.

The output determination portion 17 generates a pulse signal by setting the pulse to a high level at the timing when the count generated by the counter portion 18 becomes a, and by setting the output to a low-level at the timing when the count becomes a+b after a time for the pulse width b elapses. In other words, the output determination portion 17 generates pulse signals such that the output becomes a high-level at timing A and a low level at timing B as shown in FIG. 14. In this way, the pulse signal generation portion 85 counts the modulated clock and generates pulse signals to set the lighting time of the light-emitting portions 50 when forming an electrostatic latent image for one line in the main scanning direction.

The pulse width table, the line delay signal, and the pixel delay signal are sent from the register portion 82. Therefore, the rewriting of the data in the register section 82 permits the respective values to be changed in units of clock periods. In this embodiment, the line delay is specified as "6" by the line delay signal, the pixel delay signal is specified as "4" which is the same in all pulse signal generation portions 85, and a=10 in all pulse signal generation portions 85. Also, the image data is represented with 1 bit. Therefore, the pulse width b set in the pulse width table has the values shown in FIG. 13B.

<Analog Portion>

Next, the configuration of the analog portion 86 will be described. In the following description, only the two drive portions 61 that drive the two light-emitting portions 50 will be described. However, all the light-emitting portions 50 are driven in the same manner.

Figure 15:
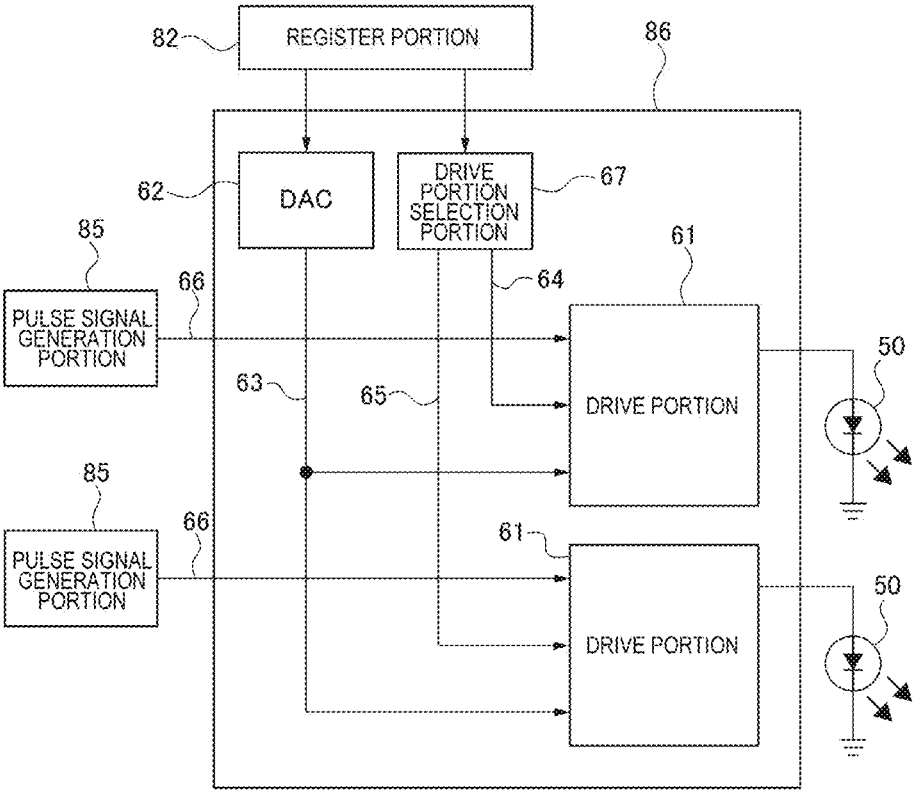
FIG. 15 is a block diagram showing the configuration of an analog portion.

FIG. 15 is a block diagram showing the configuration of the analog portion 86. As shown in FIG. 15, the analog portion 86 includes the drive portions 61 that drive the light-emitting portions 50, the DAC 62 (digital-to-analog converter), and the drive portion selection portion 67.

Based on the data set in the register portion 82 to the drive portion 61, the DAC 62 supplies the analog voltage that determines the drive current via the signal line 63. The pulse signals generated by the pulse signal generation portions 85 are input to the drive portions 61 via the signal lines 66. In this way, the analog voltages that determine the drive currents and the pulse signals are input to the drive portions 61. The drive portions 61 then control the drive currents and lighting times of the light-emitting portions 50 based on the analog voltages and the pulse signals by means of the drive circuits described below.

Based on the data set in the register portion 82, the drive portion selection portion 67 supplies drive selection signals that select one between the drive portions 61 to the two drive portions 61 via signal lines 64 and 65. Here, the drive portion selection signals are generated such that only the signal connected to the selected drive portion 61 has a high-level voltage. For example, when the upper drive portion 61 out of the drive portions 61 shown in FIG. 13 is selected, a high-level voltage is supplied only to the signal line 64, and a Low-level voltage is supplied to the signal line 65. An analog voltage from DAC 62 that determines the drive current is set in each drive portion 61 when the drive portion selection signal indicates a high-level voltage. The CPU 73 sequentially selects one of the drive portions 61 via the register portion 82. Then, by setting analog voltages to the selected drive portions 61 one after another, the analog voltages of all the drive portions 61 are set with only the single DAC 62.

Figure 16:
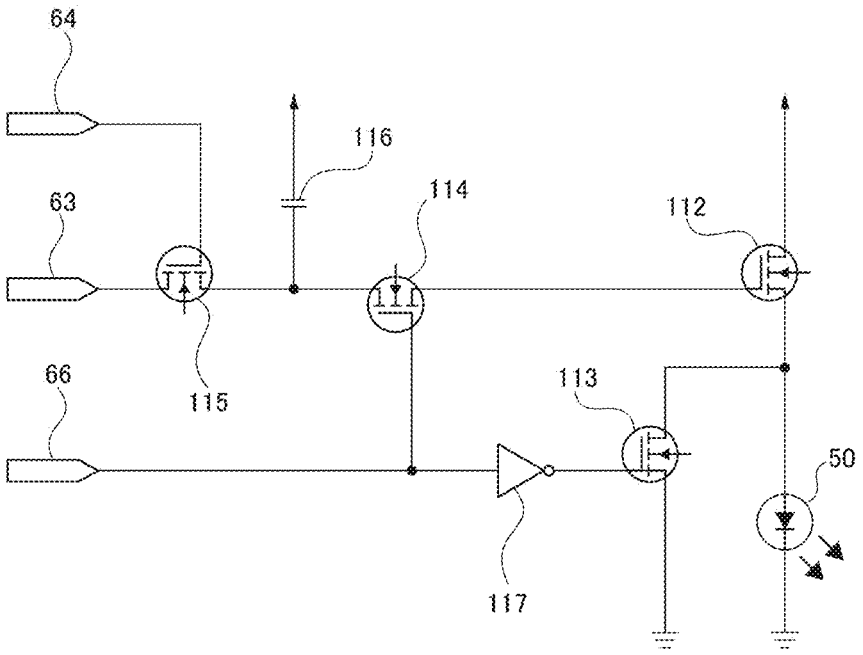
FIG. 16 is the circuit diagram of a drive portion.

Next, the configuration of the drive portion 61 will be described. FIG. 16 is a circuit diagram of the drive portion 61. As shown in FIG. 16, the drive portion 61 includes MOSFETs (Metal Oxide Semiconductor Field Effect Transistor) 112 to 115, the capacitor 116, and the inverter 117.

The MOSFET 112 supplies a drive current to the light-emitting portion 50 according to the value of the gate voltage, and controls the current such that the drive current is turned off (for lighting off) when the gate voltage is at a low-level. The gate of the MOSFET 114 is connected to the signal line 66. The MOSFET 114 applies the voltage charged in the capacitor 116 to the gate of the MOSFET 112 when the PWM (Pulse Width Modulation) signal input via the signal line 63 is at a high-level.

The drive portion selection signal sent from the drive portion selection portion 67 is provided to the gate of the MOSFET 115 via the signal line 64. When the input drive portion selection signal is at a high-level, the MOSFET 115 is turned on and the capacitor 116 is charged with the analog voltage output from the DAC 62 and transmitted via the signal line 63. In this embodiment, the DAC 62 sets an analog voltage in the capacitor 116 before the image formation, and the analog voltage level is being held by turning off the MOSFET 115 during the image formation.

As described above, the MOSFET 112 supplies to the light-emitting portion 50 the drive current according to the set analog voltage and the pulse signal. A slow turn off response speed due to large amount of input capacitance of the light-emitting portion 50 can be sped up by the MOSFET 113. The pulse signal is logically inverted by the inverter 117 and the logically inverted pulse signal is input to the gate of the MOSFET 113. When the pulse signal is at a low-level, a high-level signal is input to the gate of the MOSFET 113, thereby forcibly discharging the charge in the input capacitance of the light-emitting portion 50.

<Image Data Transfer>

Next, the image data transfer from the image controller portion 70 to the light-emitting element array chip 40 will be described.

Figure 17:
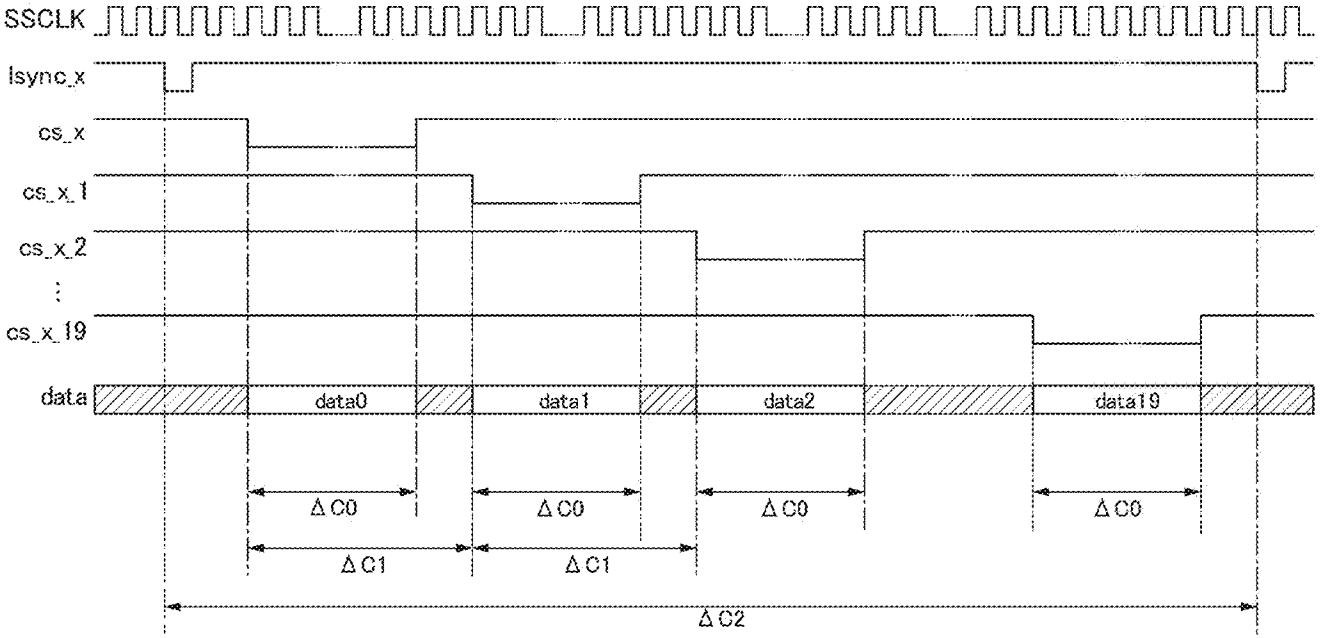
FIG. 17 is a timing chart showing the relationship between a chip selection signal which is passed between the light-emitting device array chips 40, a modulated clock, a line synchronization signal, and an image data signal.

FIG. 17 is a timing chart showing the relationship among the chip select signals cs_x, cs_x_1 to cs_x_19 passed between the light-emitting element array chips 40, the modulated clock (SSCLK), the line synchronization signal lsync_x, and the image data signal data.

The chip selection signal cs_x shown in FIG. 17 is input to the light-emitting element array chip 40*a* from the chip data conversion portion 72 via the chip selection signal line 75 as shown in FIG. 8. Similarly, the chip selection signal cs_x_1 shown in FIG. 17 is input to the light emitting element array chip 40*b* from the light-emitting element array chip 40*a*, which are shown in FIG. 8. Further, the chip selection signal cs_x_2 shown in FIG. 17 is input to the light-emitting element array chip 40*c* from the light-emitting element array chip 40*b*, which are shown in FIG. 8. Furthermore, the chip selection signal cs_x_19 shown in FIG. 17 is input to the 20th light-emitting element array chip 40 that is the last one in the cascade connection from the light-emitting element array chip 40*a* shown in FIG. 8.

The light-emitting portions 50 for one line in the main scanning direction included in the light-emitting element array chip 40 connected in nth position among the light-emitting element array chips 40 connected in cascade emit light based on the image data data (n−1) shown in FIG. 17. For example, the light-emitting portions 50 for one line included in the light-emitting element array chip 40*a* emit light based on the image data data0, and the light-emitting portions 50 for one line included in the light-emitting element array chip 40*c* emit light based on the image data data2.

As shown in FIG. 17, the chip selection signal becomes at a low level for the clock cycles ΔC0 required to transfer the image data signal data0, based on which the light-emitting portions 50 for one line in the light-emitting element array chip 40 emit light. In this embodiment, the image data for one light-emitting portion 50 is transferred per clock cycle, and ΔC0 corresponds to 748 cycles. The configuration may be adopted in which image data for multiple light-emitting portions are transferred in one cycle, or image data for one light-emitting portion are transferred in multiple cycles.

The chip selection signal cs_x input to the light-emitting element array chip 40 from the chip data conversion portion 72 is delayed by ΔC1 cycles by the chip selection signal generation portion 83 and is output as the chip selection signal cs_x_1. The value ΔC1 is obtained by adding to the value ΔC0 the delay time required for generating the chip select signal. In this embodiment, it takes two cycles to generate the chip select signal, so that the value ΔC1 is determined to be equal to 750 cycles. As a result, the chip selection signal generation portion 83 of the light-emitting element array chip 40*a* generates the chip selection signal cs_x_1 such that the chip selection signal cs_x_1 and the chip selection signal cs_x do not become at a low level at the same time.

The other light emitting element array chips 40 also generate chip selection signals to be output in the same way such that the chip selection signals to be output and the input chip selection signals do not become at a low level at the same time. As a result, the respective chip selection signals sequentially become at a low level in the order of cs_x→cs_x_1→cs_x_2→ . . . cs_x_19.

The period ΔC2 of the line synchronization signal lsync_x should be longer than the time until the chip selection signal cs_x_19 is input to the 20th light emitting element array chip 40 which is the last one in cascade connection in order to send image data to all the light-emitting element array chips 40. This is represented in the following Expression 1.

$$\Delta C2 \geq \Delta C1 \times 20 \quad \text{(Equation 1)}$$

In this embodiment, ΔC2 is set to be equal to 16000 cycles. Based on the data for the light-emitting portions 50 transferred within one period of the line synchronization signal lsync_x, all the light-emitting portions 50 are controlled to emit light simultaneously in the next lsync_x period at the time T2 shown in FIG. 12.

<Relationship Between Periods of Modulated Clock and Period of Line Synchronization Signal>

Next, the relationship between the period of the modulated clock generated by the SSCLK generation portion 55 and the period of the line synchronization signal generated by the synchronization signal generation portion 74 will be described.

As described above, the SSCLK generation portion generates a modulated clock generated by frequency-modulating a reference clock. In this embodiment, the SSCLK generation portion 55 performs a center spread modulation with the modulated clock having a frequency-modulation cycle of 1600 cycles of the modulated clock, and with the center value of its frequency being 100 MHz±1%.

Figure 18A:
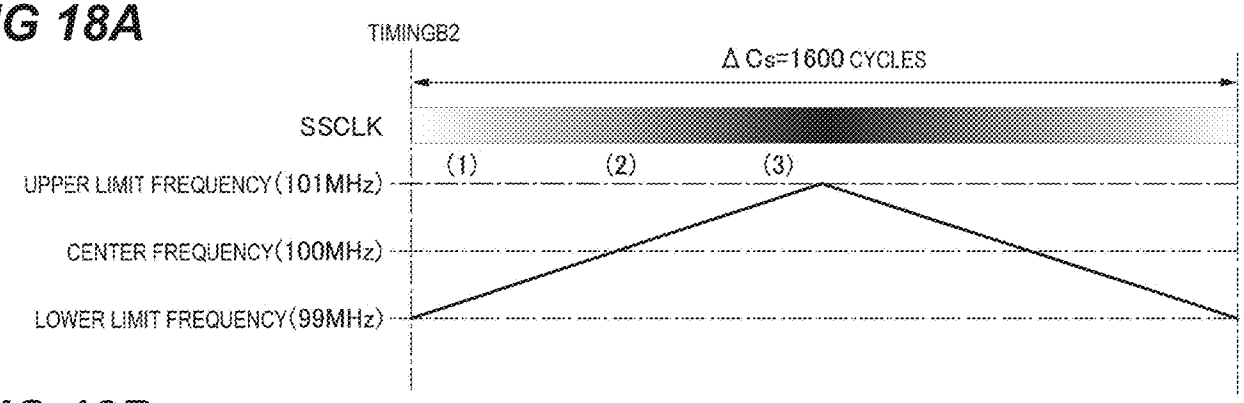
FIG. 18A shows the variation in frequency of the modulated clock.

FIG. 18A shows the variation of the frequency of the modulated clock. In FIG. 18A, the darker colored portion of the modulated clock indicates clock signals with higher frequencies and the lighter colored portion indicates clock signals with lower frequencies. The middle density portion of the modulated clock corresponds to the reference frequency and the modulation period ΔC corresponds to 1600 cycles of the modulated clock. This translates to a modulation frequency of 62.5 kHz. In many cases, the clock modulation frequency is set from 10 to 100 kHz to prevent radiation noise, but it is sufficient for this value to be set within the range that satisfies target values of CISPR, etc.

Figure 18B:
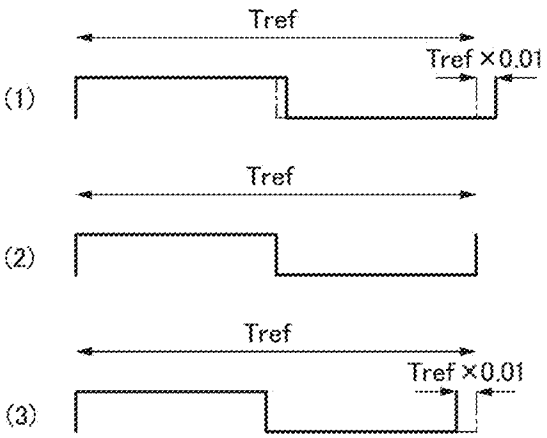
FIG. 18B shows waveforms of the modulated clock.

FIG. 18B shows waveforms of the modulated clock at the points (1), (2), and (3) shown in FIG. 18A. As shown in FIG. 18B, at the point (1), where the frequency is lowest in the modulation cycle, the frequency is 1% lower than the reference frequency at the point (2). On the other hand, at the point (3), where the frequency is the highest in the modulation cycle, the frequency is 1% higher than the reference frequency at the point (2). Since the frequency modulation period ΔCs of the modulated clock corresponds to 1600 cycles of the modulated clock and the period ΔC2 of the line synchronization signal lsync_x corresponds to 16000 cycles of the modulated clock, the relationship between the frequency modulation period ΔCs of the modulated clock and the period ΔC2 of the line synchronization signal lsync_x may be expressed by the following Equation 2. In Equation 2, Nis an integer greater than 1 and less than or equal to 15, and in this embodiment, N=10.

$$\Delta C2 = N \times \Delta Cs \quad \text{(Equation 2)}$$

According to Equation 2, the relationship between the modulation period Tf of the clock and the time T1 for forming an electrostatic latent image for one line in the main scanning direction may be expressed by Equation 3 shown below.

$$Tf = Tl/N \quad \text{(Equation 3)}$$

Figure 19A:
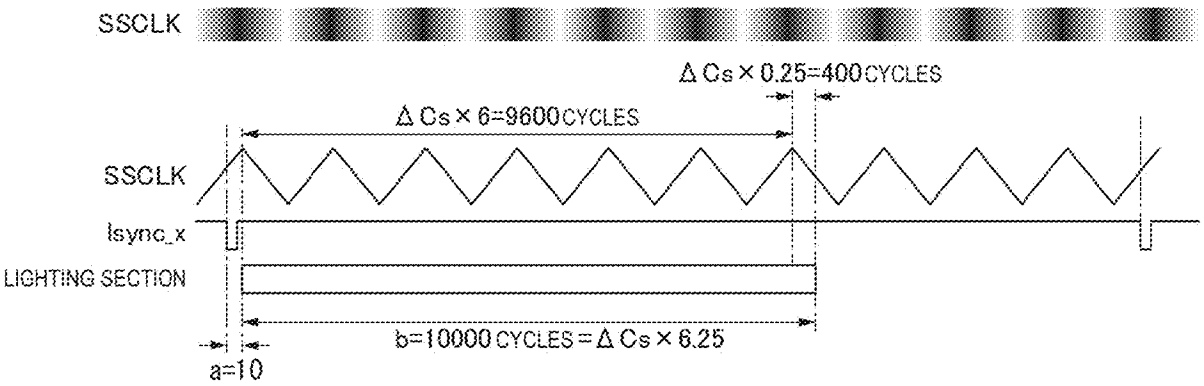
FIGS. 19A and 19B are timing charts showing the line synchronization signal and the lighting section of the light-emitting portions during image formation.

FIG. 19A is a timing chart showing the line synchronization signal lsync_x and the lighting section of the light-emitting portions 50 during image formation in this embodiment. In FIG. 19A, the modulation of the modulated clock is shown in both shading and waveform as in FIG. 18A. As shown in FIG. 19A, the light-emitting portions 50 start emitting light (lighting) for forming an image after 10 cycles as the pulse signal delay time a in response to the line synchronization signal lsync_x, and light-emitting portions 50 continue to emit light for a lighting section of 1000 cycles as the pulse width b. One period of the line synchronization signal lsync_x is equivalent to 10 periods of the modulation of the modulated clock.

Also, as shown in Equations 2 and 3, the period of the line sync signal lsync_x is set to be the modulation clock period multiplied by an integer, so that the line synchronization signal lsync_x is generated each time when the modulated clock becomes in a predetermined phase. Therefore, the lighting time length of the light-emitting portions 50 per a line becomes constant, and the accumulated light amount of the light-emitting portions 50 per line becomes constant, so that the density of each line of the output image becomes uniform. Therefore, according to the configuration of this embodiment, unevenness in image density in the sub-scanning direction can be suppressed while reducing radiation noise by spread spectrum.

Figure 19B:
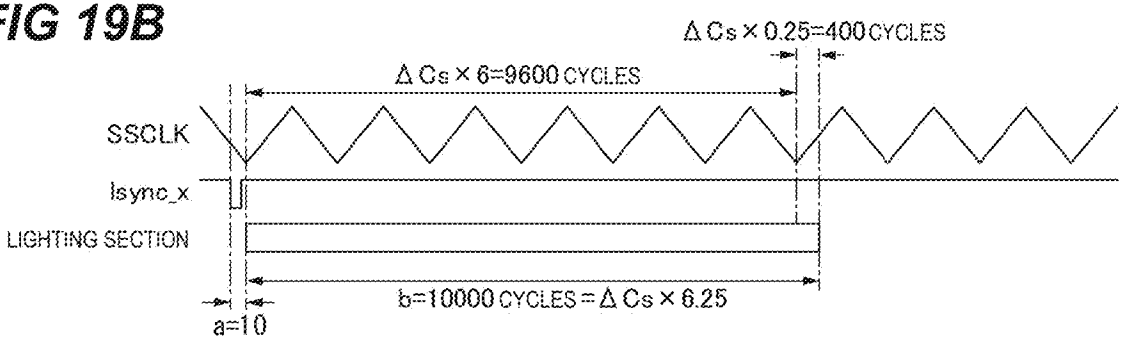

In other words, if the period of the line synchronization signal lsync_x was not set to be the length of the period of modulated clock multiplied by an integer, the subsequent line synchronization signal lsync_x would be generated when the phase of the modulated clock is 180 degrees out of phase, as shown in FIG. 19B, for example. In this case, since the lighting section of the light-emitting portions 50 is 6.25 times the 1600 cycles which corresponds to the cycle ΔCs of the modulated clock, the last 400 cycles corresponding to 0.25 times of a fraction is counted at a frequency lower than the center frequency of the modulated clock. Therefore, the lighting period of the light-emitting portions 50 during this period is longer than 400 cycles at the center frequency, and the total time is longer than that of 10000 cycles at the center frequency alone, so that an accumulated light amount becomes larger. On the other hand, as shown in FIG. 19A, the last 400 cycles corresponding to 0.25 times of a fraction in the previous lighting time of the light-emitting portions 50 is counted at a frequency higher than the center frequency of the modulated clock, so that the actual time becomes shorter than the 400 cycles at the center frequency. As a result, the lighting section of the entire light-emitting portions 50 becomes shorter than the time of 10000 cycles at the center frequency alone, so that the accumulated light amount becomes smaller. As described above, if the phase of the modulated clock at a time when the line synchronization signal lsync_x is generated differs for each line, the lighting time of the light-emitting portions 50 differs for each line, resulting in uneven image density for each line in the output image and uneven density in the sub-scanning direction.

In contrast, according to the configuration of the present embodiment, the period of the line synchronization signal lsync_x is set to be the length of the modulation clock period multiplied by an integer, so that the lighting time of the light-emitting portions 50 for each line becomes the same. Therefore, the image density of each line in the output image is made uniform, and uneven density in the sub-scanning direction of the output image may be suppressed.

Second Embodiment

Next, the second embodiment of the image forming apparatus will be described using the figures. The same reference symbols are added to the same parts as those of the first embodiment and descriptions for them are omitted.

FIG. 20 is a block diagram of the image controller portion 70 of the image forming apparatus A of this embodiment. As shown in FIG. 20, the configuration of the image controller portion 70 of this embodiment differs from the configuration of the first embodiment in that the SSCLK generation portion 55 and the synchronization signal generation portion 74 are common to all colors. The synchronization signal generation portion 74 generates the line synchronization signal lsync_x for each color separately. The rest of the configuration is the same as that of the configuration of the first embodiment.

FIG. 21 is a timing chart showing the operations of the synchronization signal generation portion 74, which generates the line synchronization signal lsync_x(Y) when forming a yellow toner image and the line synchronization signal lsync_x(M) when forming a magenta toner image. The description of the generation of the line synchronization signals lsync_x (C) and lsync_x (K) for forming cyan and black toner images is omitted below. They are generated in the same way as the generation of the line synchronization signal lsync_x (M) for magenta.

Figure 21A:
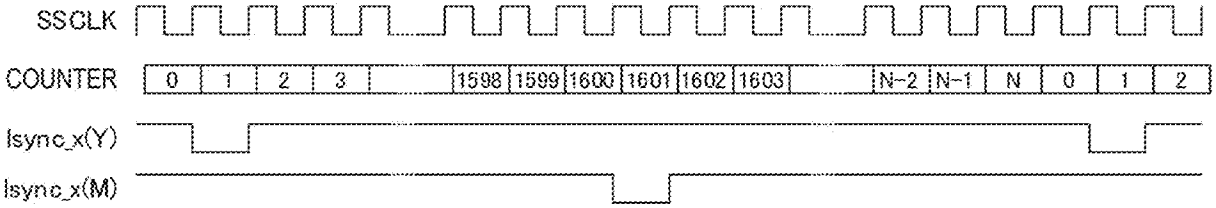
FIGS. 21A and 21B are timing charts showing the operation of the synchronization signal generation portion for generating a line synchronization signal for each color.

As shown in FIG. 21A, the counter of the synchronization signal generation portion 74 counts up according to the input modulated clock, and is cleared to 0 when the count value becomes the same as the value N indicated by the CPU 73. At the leading edge of the modulated clock when the value of the counter is 0, the synchronization signal generation portion 74 generates the line synchronization signal lsync_x (Y), which is a low pulse of one cycle width. At the leading edge of the modulated clock when the value of the counter is 1600, on the other hand, the synchronizing signal generator 74 generates the line synchronizing signal lsync_x (M), which is a low pulse of one cycle width.

When the color misalignment occurs in the sheet S conveying direction between the yellow toner image and the magenta toner image, this color misalignment can be corrected by shifting the line synchronization signal lsync_x for each toner image color as described above. For example, when a yellow toner image and a magenta toner image are offset by half a line, the writing timing in the sub-scanning direction is shifted by half a line by shifting the phase of the line synchronization signal lsync_x(M) by half a period with respect to the line synchronization signal lsync_x(Y) to correct this color misalignment.

Figure 21B:
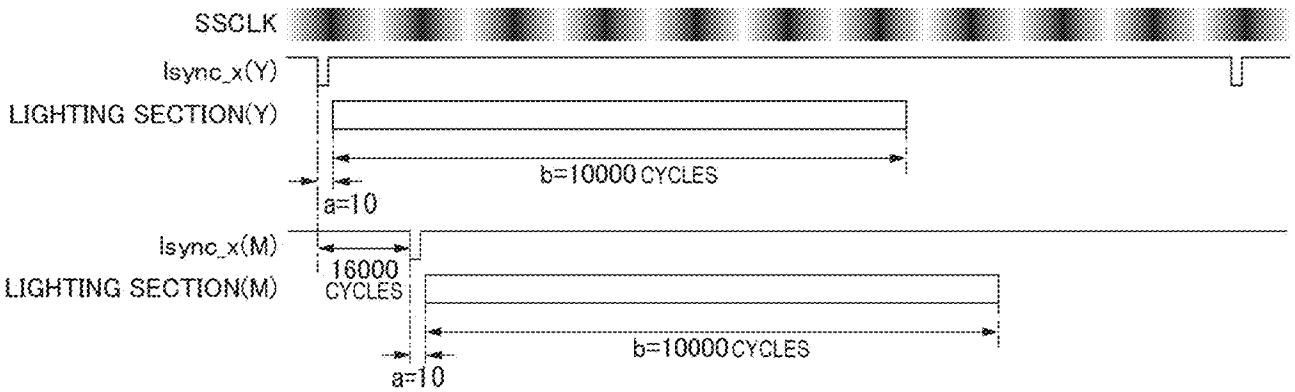

The timing at which the synchronization signal generation portion 74 generates the line synchronization signal lsync_x (M) is set to M times the number of the modulated clock cycles ΔCs by the SSCLK generator 55. The value of M is an integer greater than or equal to 1 and less than the integer N shown in Equation 3. As shown in FIG. 21B, the generation timing (phase) of the line synchronization signal lsync_x(M) is shifted by the number of the modulation cycles ΔCs×M (in this case, M=1) of the modulated clock from that of the line synchronization signal lsync_x(Y). In other words, when the modulation period of the modulated clock generated by the SSCLK generation portion 55 is Tf, the phase of frequency of the line synchronization signal lsync_x is Tf×M. By shifting the timing at which the line synchronization signal lsync_x is generated for each color by the unit of ΔCs in this way, the lighting time for each line of the light-emitting portion 50 of the exposure head 6 for each color can be made constant, and the density of each line of the output image can be made uniform.

Therefore, according to the configuration of this embodiment, the color misalignment in the conveying direction of the sheet S can be corrected while suppressing unevenness in image density in the sub-scanning direction and reducing radiation noise by spread spectrum.

Third Embodiment

Next, the third embodiment of the image forming apparatus will be described using the figures. The same reference symbols are added to the same parts as those of the first and second embodiments and descriptions for them are omitted.

The configuration of this embodiment differs from that of the second embodiment in that the image data is represented by 2-bit (4 shades), not 1-bit. For this reason, as shown in FIG. 22, the values of the pulse width table stored in the register portion 82 are different from those of the first embodiment. The rest of the configuration is the same as that of the configuration of the second embodiment.

As shown in FIG. 22, the values of the pulse width table stored in the register portion 82 are set such that the pulse widths b for the image data values are integers multiplied by the period ΔCs of the modulated clock generated by the SSCLK generation portion 55. In other words, Tv=Tf×K (K is an integer greater than or equal to 1 and less than or equal to 10) where Tv denotes lighting time of the light-emitting portions 50 for forming one pixel and Tf denotes the period of the modulated clock.

Figure 23A:
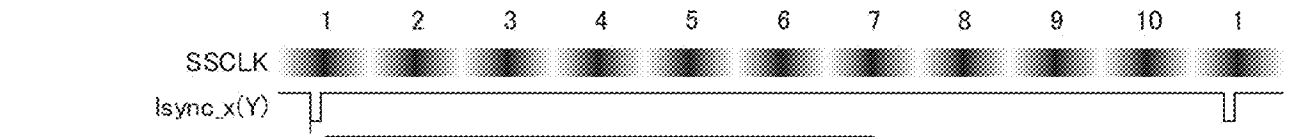
FIGS. 23A and 23B are timing charts showing the relationship between the lighting section of the light-emitting portion, the modulated clock, and the line synchronization signal.
Figure 23B:
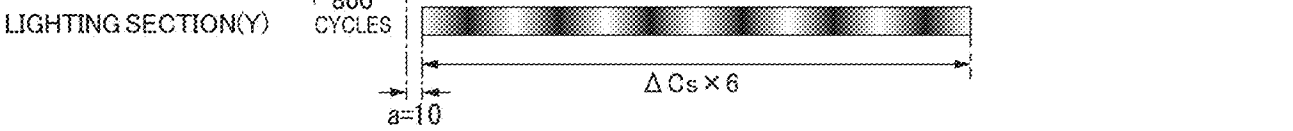

FIG. 23A is a timing chart showing the relationship between the lighting section of the light-emitting portion 50 of the exposure head 6Y, the modulated clock and the line synchronization signal lsync_x(Y) in the case where the image data is "2". FIG. 23B is a timing chart in the case where the phase of the line synchronization signal lsync_x (Y) is delayed by 800 cycles as compared in the case of FIG. 23A. In FIGS. 23A and 23B, the frequency of the modulated clock for the lighting section of the light-emitting portion 50 is represented by shading, as in FIG. 21B, with a higher frequency of the modulated clock being represented as a darker shading and a lower frequency being represented as a lighter shading.

In the configuration of this embodiment, a frequency average of the modulated clock in the lighting section of the light-emitting portion 50 is a median value in both cases shown by FIGS. 23A and 23B. Namely, it can be found by the phase relationship between the modulated clock and the line sync signal lsync_x(Y) that the lighting time Tv in the lighting section of the light-emitting portions 50 in the case of FIG. 23A is equal to that in the case of FIG. 23B.

Thus, with the configuration of this embodiment, the lighting time lengths of the light-emitting portions 50 for each page can be made the same even when there are no restrictions as described in the second embodiment regarding the relationship between the phase of the modulated clock and the phase of the line synchronization signal. Accordingly, the image density of each page in the output image is made uniform, and unevenness in density of each can be suppressed.

Fourth Embodiment

Next, the fourth embodiment of the image forming apparatus will be described using the figures. The same reference symbols are added to the same parts as those of the first, second and third embodiments and descriptions for them are omitted.

Figure 24:
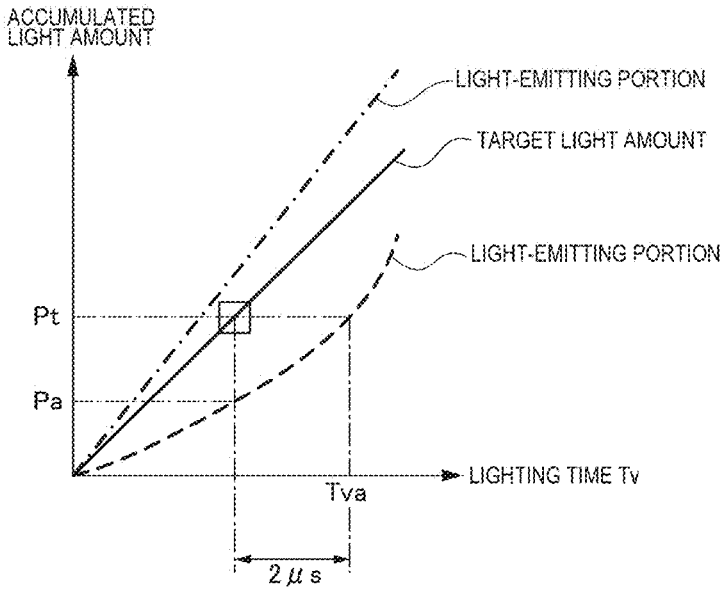
FIG. 24 is a graph showing the relationship between a lighting time and an accumulated light amount when the light-emitting portion forms a single pixel.

FIG. 24 is a graph showing the relationship between the lighting time Tv and the accumulated light amount when the light emitting portion 50 forms one pixel. As shown in FIG. 24, the relationship between the lighting time Tv of the light-emitting portion and the accumulated light amount varies from one light-emitting portion to another and also deviates from the target light amount. For example, as shown in FIG. 24, there are some light-emitting portions whose accumulated light amount is non-linear with respect to the lighting time Tv and whose accumulated light amount is lower than the target light amount, and there are some light-emitting portions which has linearity in relationship between the lighting time Tv and the accumulated light amount and whose accumulated light amount is higher than the target light amount. The cause of this variation in the accumulated light amount with respect to the lighting time Tv in the respective light-emitting portions may be individual differences in the light-emitting portions or variations in the circuitry that drives the light-emitting portions.

In contrast, this embodiment is configured to correct the pulse width b of the pulse signal generated by the pulse signal generation portion 85 in order to suppress the deviation of the accumulated light amount of the light-emitting portions 50 shown by the broken line in FIG. 24. The configuration of this embodiment is as outlined as follows. For example, as shown in FIG. 23, when the image data is "2" as a value in the design and the lighting section (Y) is set with the cycles ΔCs×6 as in the third embodiment, the accumulated light amount Pa of the light-emitting portion 50 is lower than the target light amount Pt. In this case, the accumulated light amount is brought closer to the target light amount Pt as correction for the case where the image data of the light-emitting portion 50 is "2" by extending the lighting time. The specific method of correcting the accumulated light amount of the light-emitting portion 50 will be described below. The configuration of the image forming apparatus A of this embodiment is the same as that of the third embodiment, except for the control related to the correction of the accumulated light amount of the light-emitting portion 50 described below.

Figure 25:
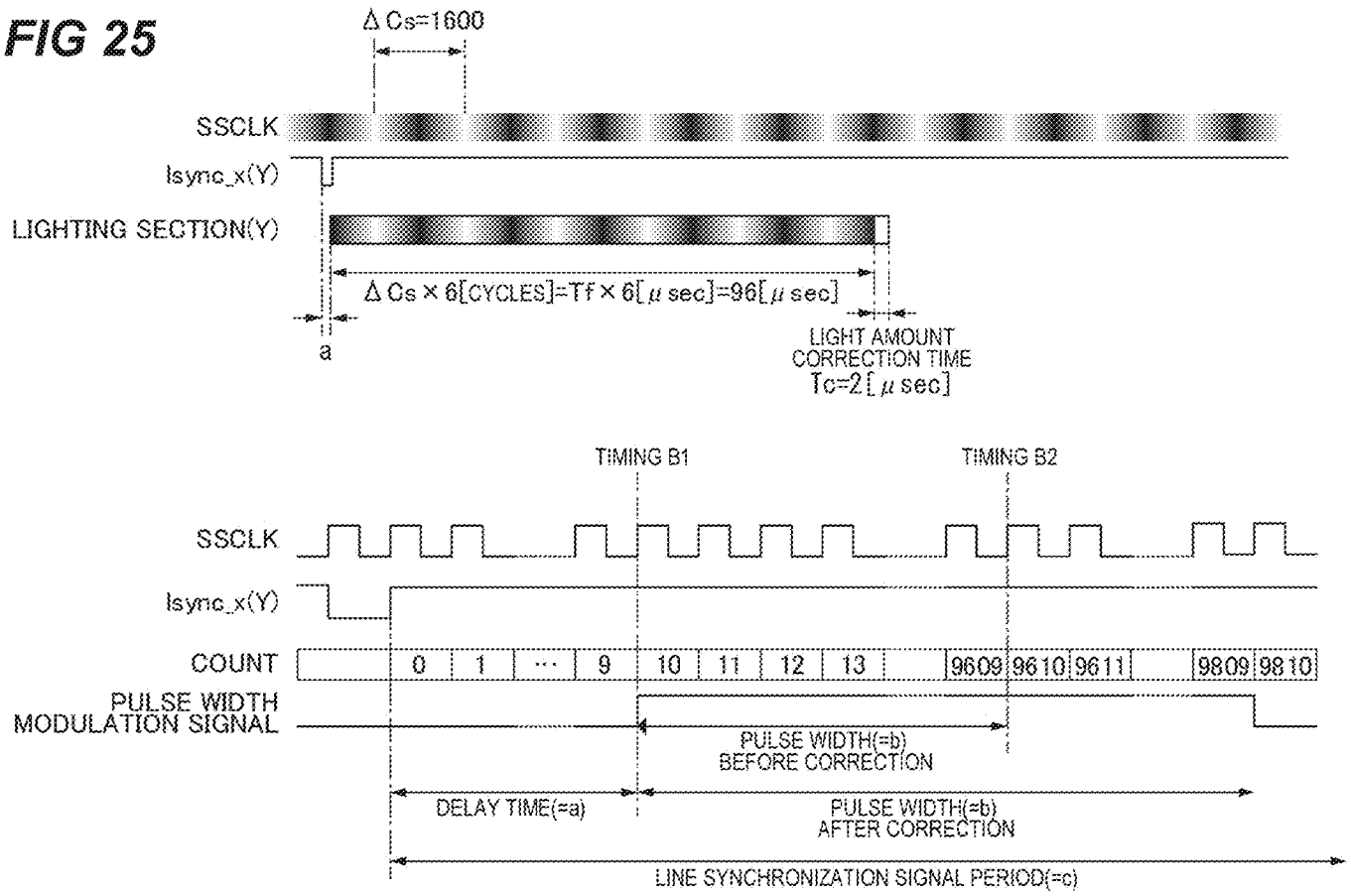
FIG. 25 is a timing chart of the pulse signal generation portion when a lighting time of the light-emitting portion is corrected.

FIG. 25 is a timing chart of the pulse signal generation portion 85 when the lighting section (Y), which is the lighting time of the light-emitting portion 50, is corrected in order to bring closer to the target light amount Pt the accumulated light amount of the light-emitting portion 50 shown by the broken line in FIG. 24. In FIG. 25, the frequency of the modulated clock for the lighting section of the light-emitting portion 50 is represented by shading, as in FIG. 21B, with a higher frequency of the modulated clock being represented as a darker shading and a lower frequency being represented as a lighter shading.

As shown in FIG. 25, in this embodiment, the number of cycles corresponding to the delay time a from the trailing edge of the line synchronization signal lsync_x (Y) to the lighting section (Y) is set to 10, and the lighting section (Y) starts from the time when the modulated clock reaches the upper limit frequency of 101 MHz. If the spectrum of the reference clock were not spread by the SSCLK generation portion 55 and were always operating at the center frequency of 100 MHz, the pulse width b would simply be extended by 2 μsec in order to bring to the target light amount Pt the accumulated light amount of the light-emitting portion 50. In other words, the pulse width b of 9600 cycles, which is equivalent to ΔCs×6 would be extended by 200 cycles, which is equivalent to 2 μsec.

However, in this embodiment, the spectrum of the reference clock is spread by the SSCLK generation portion 55, so that a corresponding error occurs for this. In this embodiment, the frequency of the modulated clock reaches the upper limit of 101 MHz both at the timing B1 and the timing B2 shown in FIG. 25. Therefore, when simply extending the pulse width by 200 cycles, the actual extension time will be shorter because the frequency of this section is higher than the center frequency. Therefore, the number of extended cycles ES1 corresponding to 2 μsec at 100.75 MHz, which is the average frequency of the 200-cycle period, is obtained using the following Equation 4.

$$ES1=2/(1/100.75)=201.5 \quad \text{(Equation 4)}$$

The number of extended cycles is thus corrected as 202 cycles (rounded to the nearest whole number), which is the value obtained from Equation 4. This makes it possible to correct the accumulated light amount of the light-emitting portion 50 to the target light amount Pt with high accuracy.

Figure 26A:
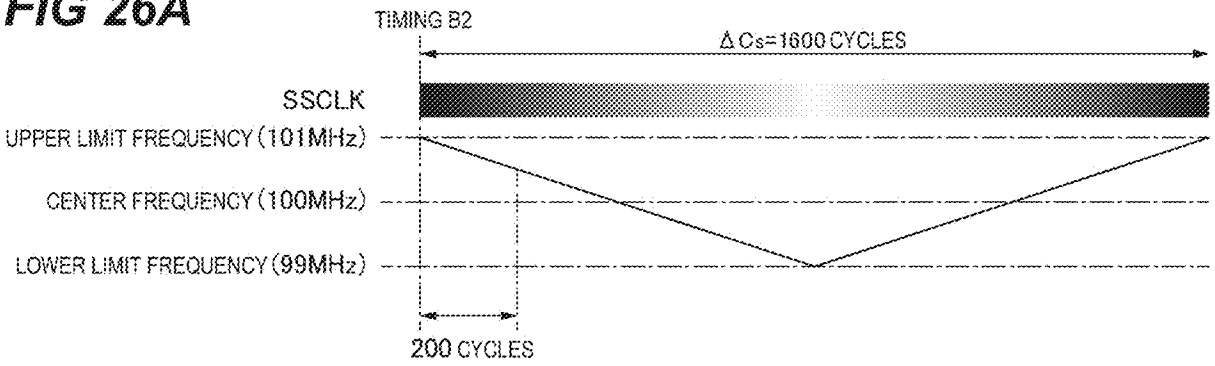
FIGS. 26A and 26B show the relationship between a frequency of the modulated clock and the extended cycles.
Figure 26B:
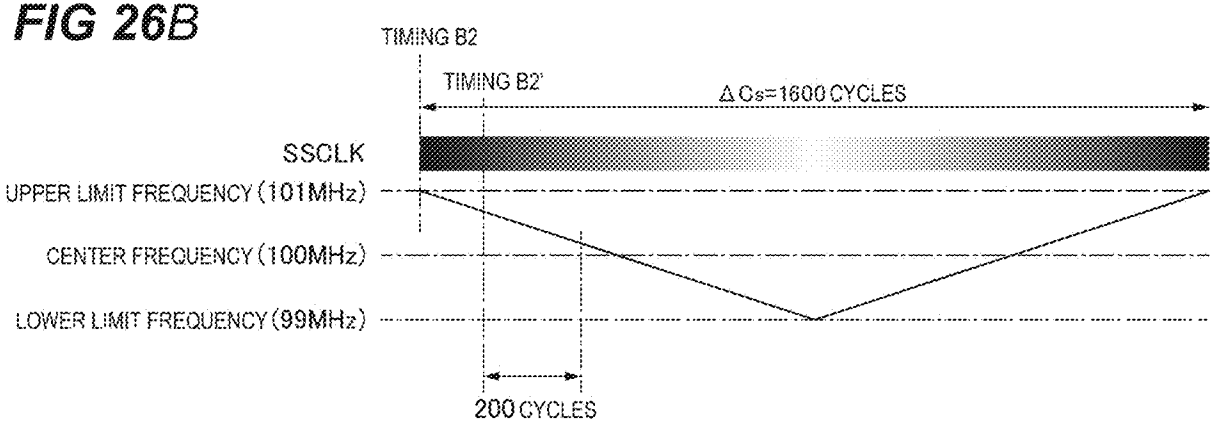
Figure 27A:
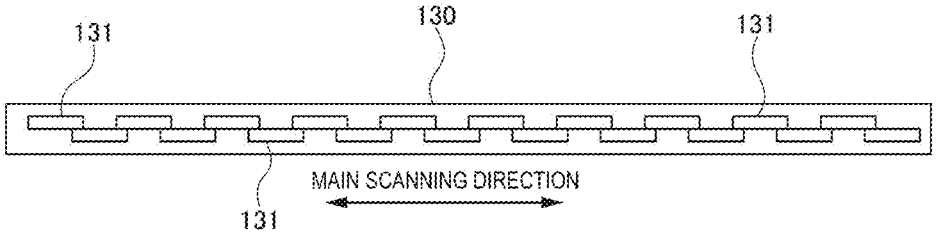
FIGS. 27A, 27B and 27C show the configuration of a conventional exposure head and SLED chips.
Figure 27B:
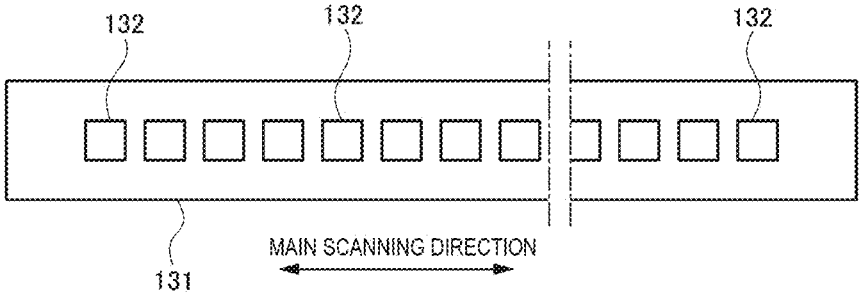
Figure 27C:
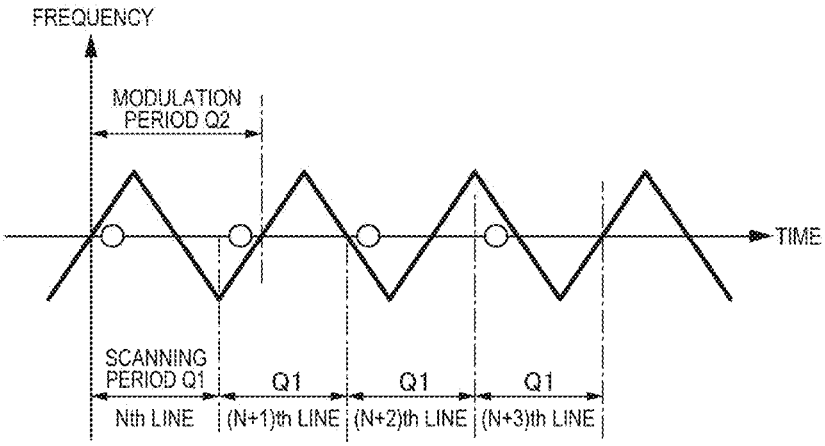
Figure 28A:
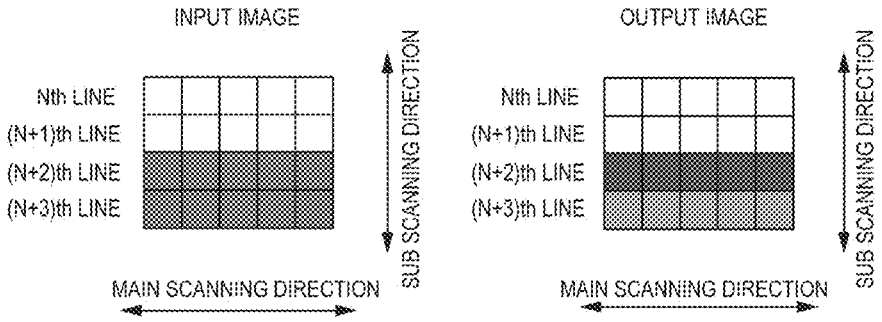
FIGS. 28A and 28B show the comparison of input images input to a conventional image forming apparatus with output images output to a sheet by image formation of a conventional image forming apparatus.
Figure 28B:
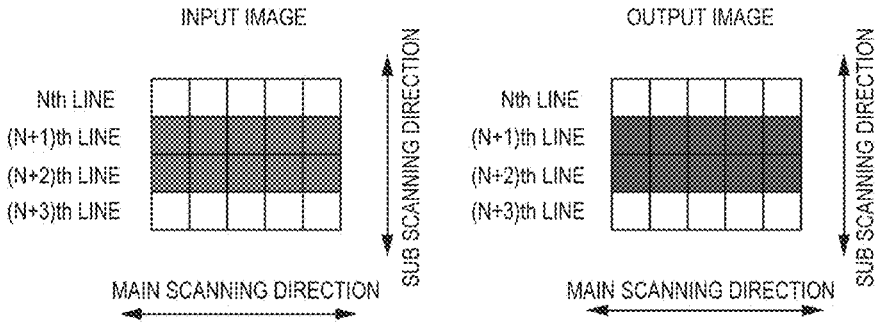

Next, the case will be described where the phase of the line synchronization signal lsync_x(Y) is delayed 100 cycles after the timing shown in FIG. 25 due to the color malalignment correction described in the second embodiment. In this case, as shown in FIGS. 26A and 26B, the timing B2 occurs 100 cycles after the timing B2'. Therefore, the number of extended cycles ES2 corresponding to 2 μsec at 100.5 MHz, which is the average frequency of the 200-cycle section, is obtained using the following Equation 5.

$$ES2=2/(1/100.5)=201 \quad \text{(Equation 5)}$$

In this way, the number of extended cycles is corrected by 201 cycles, which is the value obtained from Equation 5. This makes it possible to correct the accumulated light amount of the light-emitting portion 50 to the target light amount Pt with high accuracy.

As described above, based on the phase of the line synchronization signal lsync_x(Y) and the frequency of the modulated clock, the pulse signal generation portion 85 of this embodiment corrects the pulse width b of the pulse signal, which is determined by referring to the pulse width table. This configuration improves the accuracy of the accumulated light amount of the light-emitting portion 50, so that image quality is improved.

In the first to fourth embodiments, an OLED system in which the light-emitting portions 50 of each exposure head 6 are simultaneously turned on and off has been described. However, the embodiments of the present invention are not limited to these configurations. That is, even if the exposure head 6 is configured to employ SLED chips and sequentially emit light from the SLED chips, the above-mentioned effect of suppressing uneven image density in the sub-scanning direction can be obtained. However, it is preferable to use the OLED system for the exposure head 6 because it can also suppress uneven image density in the main scanning direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-142795, filed Aug. 26, 2020, which is hereby incorporated by reference herein in its entirety.

What is claimed is:

1. An image forming apparatus, comprising:

a first photosensitive drum configured to be rotatable;

a second photosensitive drum configured to be rotatable;

a first plurality of light-emitting portions arranged along a direction of a rotational axis of the first photosensitive drum, the first plurality of light-emitting portions being configured to emit light based on image data in order to expose the first photosensitive drum;

a second plurality of light-emitting portions arranged along a direction of a rotational axis of the second photosensitive drum, the second plurality of light-emitting portions being configured to emit light based on image data for exposing the second photosensitive drum; and one or more processors configured to:

generate a reference clock signal with a predetermined period;

generate a modulated clock signal with a predetermined modulation period by spreading a spectrum of the reference clock signal, at least one of the first and second plurality of light-emitting portions being configured to emit light for a lighting time set based on the modulated clock signal;

generate with a period of n times the predetermined modulation period (n is an integer greater than or equal to 1) a first control signal for controlling a timing at which the first plurality of light-emitting portions emits light; and generate with a period of n times the predetermined modulation period a second control signal for controlling a timing at which the second plurality of light-emitting portions emits light, the one or more processors being configured to generate the second control signal such that a phase of the second control signal is shifted by n times the predetermined modulation period relative to a phase of the first control signal.

2. The image forming apparatus according to claim 1, wherein the one or more processors increases the lighting time based on a frequency of the modulated clock signal and a phase of at least one of the first and second control signals.

3. The image forming apparatus according to claim 1, further comprising:

a first circuit board on which at least one of the first and second plurality of light-emitting portions is arranged;

a lens for focusing light emitted from the at least one of the first and second plurality of light-emitting portions onto at least one of the first and second photosensitive drums;

a holder configured to hold the first circuit board and the lens; and a second circuit board electrically connected to the first circuit board via a cable, the one or more processors being provided on the second circuit board.

4. The image forming apparatus according to claim 1, wherein each of the first and second plurality of light-emitting portions comprises:

a substrate;

a first electrode layer including electrodes separately arranged on the substrate in the direction of the rotational axis of one of the first and second photosensitive drums;

a light-emitting layer stacked on the first electrode layer, the light-emitting layer being configured to emit light when a voltage is applied thereto; and a second electrode layer arranged on an opposite side of the light-emitting layer to a side on which the first electrode layer is provided, the second electrode layer being configured to be transmissible with light.

5. The image forming apparatus according to claim 1, wherein the one or more processors generates with a period of n times the predetermined modulation period (n is an integer less than or equal to 7) the control signal.

* * * * *